US010001260B2

(12) United States Patent
Hoover

(10) Patent No.: US 10,001,260 B2
(45) Date of Patent: Jun. 19, 2018

(54) FLASHLIGHT DEVICE FOR OBSERVING OBJECTS IN A CONDUIT

(71) Applicant: Bradley W. Hoover, Minooka, IL (US)

(72) Inventor: Bradley W. Hoover, Minooka, IL (US)

( * ) Notice: Subject to any disclaimer, the term of this patent is extended or adjusted under 35 U.S.C. 154(b) by 0 days. days.

(21) Appl. No.: 14/960,880

(22) Filed: Dec. 7, 2015

(65) Prior Publication Data

US 2017/0123216 A1 May 4, 2017

Related U.S. Application Data

(60) Provisional application No. 62/176,492, filed on Feb. 19, 2015.

(51) Int. Cl.

| | |
|---|---|
| ***F21L 4/04*** | (2006.01) |
| ***F21V 7/00*** | (2006.01) |
| ***F21L 4/02*** | (2006.01) |
| *F21Y 115/10* | (2016.01) |
| *F21W 131/411* | (2006.01) |
| *F21Y 103/33* | (2016.01) |

(52) U.S. Cl.

CPC ..... *F21V 7/0075* (2013.01); *F21L 4/027* (2013.01); *F21W 2131/411* (2013.01); *F21Y 2103/33* (2016.08); *F21Y 2115/10* (2016.08)

(58) Field of Classification Search

CPC .... F21V 7/0075; F21L 4/027; F21Y 2103/33; F21Y 2115/10; F21W 2131/411; A61B 1/0607; G02B 27/025

USPC ..... 362/157–208; 359/387

See application file for complete search history.

(56) References Cited

U.S. PATENT DOCUMENTS

| | | | | |
|---|---|---|---|---|
| 5,515,201 | A * | 5/1996 | Omi | G02B 21/0008 359/368 |
| 2005/0254234 | A1* | 11/2005 | Wang | F21L 4/027 362/184 |
| 2006/0039139 | A1* | 2/2006 | Maglica | F21L 4/027 362/202 |
| 2009/0310342 | A1* | 12/2009 | Chang | F21L 4/027 362/205 |
| 2013/0170024 | A1* | 7/2013 | Teplitz | G02B 21/084 359/387 |

* cited by examiner

*Primary Examiner* — Jason Moon Han

(74) *Attorney, Agent, or Firm* — Donald Flaynik

(57) ABSTRACT

A flashlight device for observing an object in a conduit includes a plurality of lights disposed in a front end of an enclosure in a substantially annular configuration about a viewing aperture extending longitudinally through a central portion of the enclosure, and at least one battery for energizing the plurality of lights. The device allows the person via one hand to illuminate and simultaneously observe an object located at a distal portion of a conduit, while the opposite hand holds a tool that engages the distal object.

20 Claims, 22 Drawing Sheets

FLASHLIGHT DEVICE FOR OBSERVING OBJECTS IN A CONDUIT

This application is based on Provisional Application No. 62/176,492, filed Feb. 19, 2015

BACKGROUND OF THE INVENTION

1. Field of the Invention

This invention relates to a flashlight device, and more particularly, to a flashlight that includes a viewing aperture centrally and longitudinally disposed through a handheld flashlight to allow a user to hold a back end of the flashlight proximate to the user's eye, while the front end of the flashlight illuminates a relatively confined area that cannot otherwise be viewed by the user due to the flashlight obstructing the user's line of sight of the confined area.

2. Background of the Prior Art

Inspectors or repair personnel investigating a water supply valve in a "Buffalo Box" that supplies water below ground, stand at ground level and look down a vertically orientated, above ground pipe or conduit that is connected to the Buffalo Box, and view the water valve by directing a beam of light from a typical flashlight down the conduit and into the Buffalo Box. If the conduit is relatively small in diameter, viewing the valve may be difficult or impossible because the flashlight obstructs the view of the user into the conduit. A myriad of other examples can be envisioned where a person needs to look through a relatively small aperture, including but not limited to a crack in a wall to view a pipe or electrical wiring, a vent covering ductwork, access passageways in home appliances such as washer, dryers, refrigerators and dishwashers.

There is a need for a hand held flashlight with a viewing aperture that extends through the entire flashlight in line with direction light emits from the flashlight to allow a person to look through the flashlight and observe an object illuminated by the emitted light. But for the viewing aperture, the person would not be able to see the illuminated object because the flashlight would be disposed between the eye of the user and the object, thereby obstructing the user's view of the object.

SUMMARY OF THE INVENTION

Brief Description of the Drawings

Objects, advantages and novel features of the present invention, as well as details of an illustrative embodiment thereof, will be understood from the following detailed description and attached drawings, wherein:

FIG. 6 is a left side elevation view of the flashlight device of FIG. 5.

DESCRIPTION OF THE PREFERRED EMBODIMENT

Figure 1:
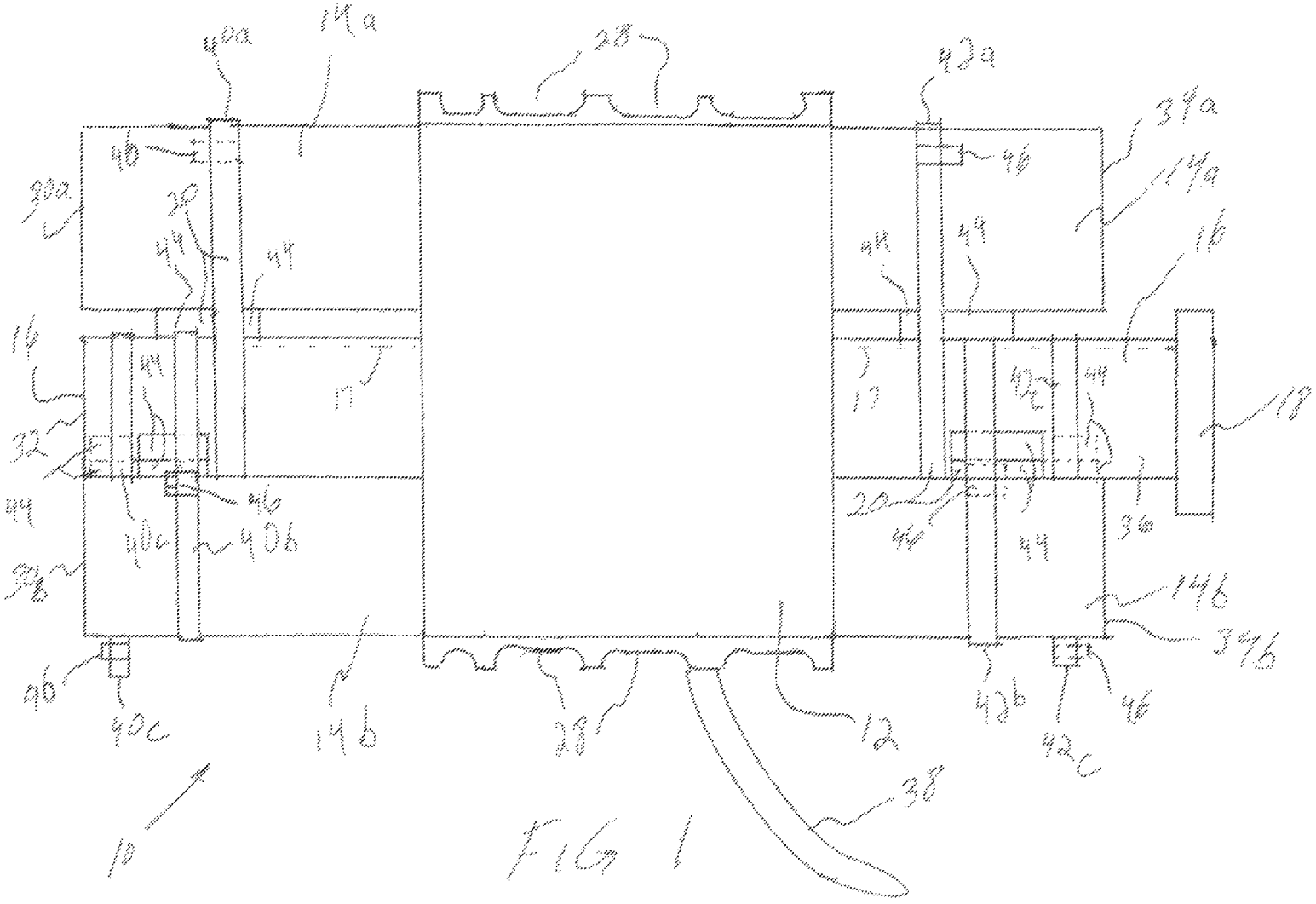
FIG. 1 is a front elevation view of a flashlight device in accordance with the present invention.
Figure 2:
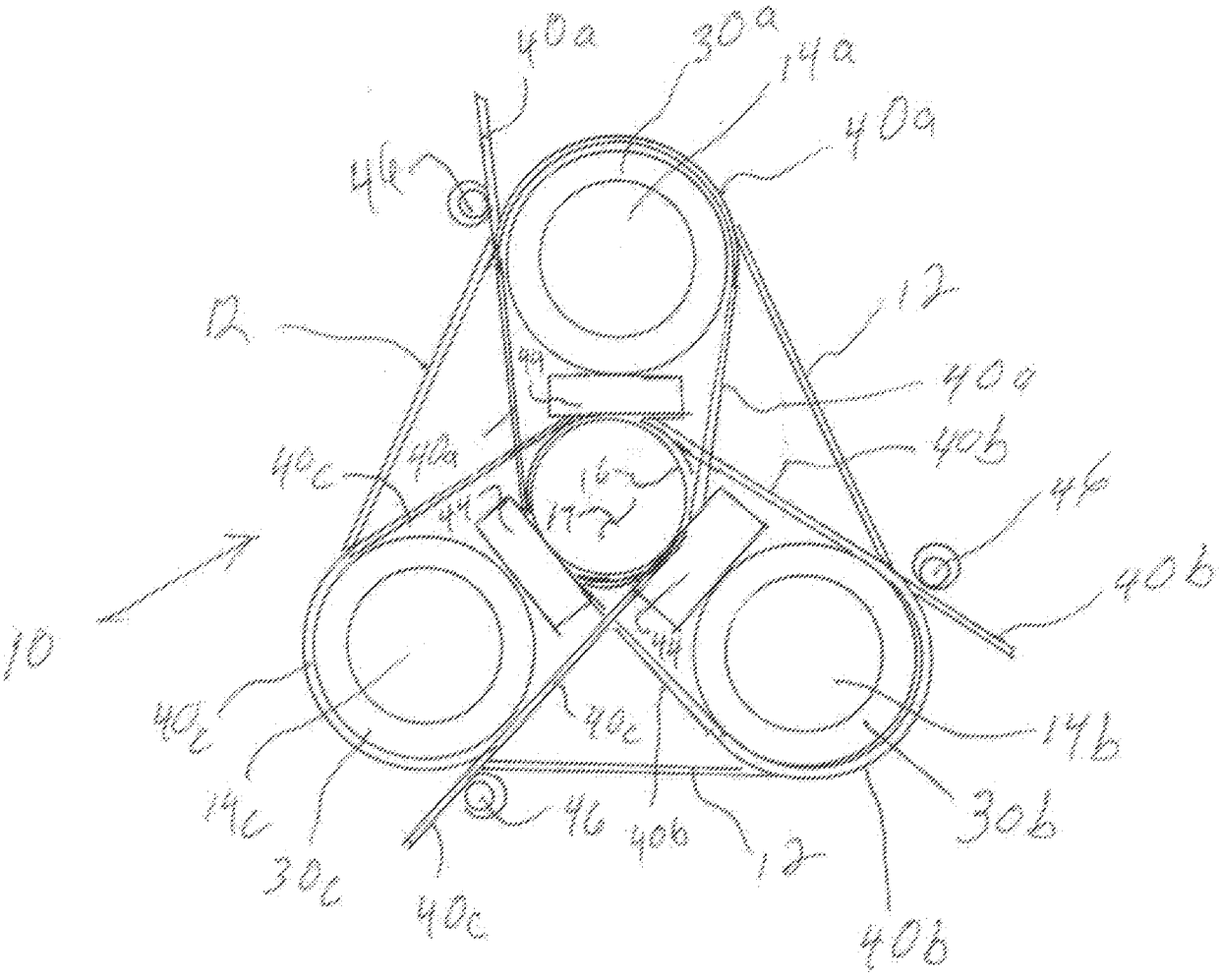
FIG. 2 is a left side elevation view of the flashlight device of FIG. 1 without an eyepiece attached.
Figure 3:
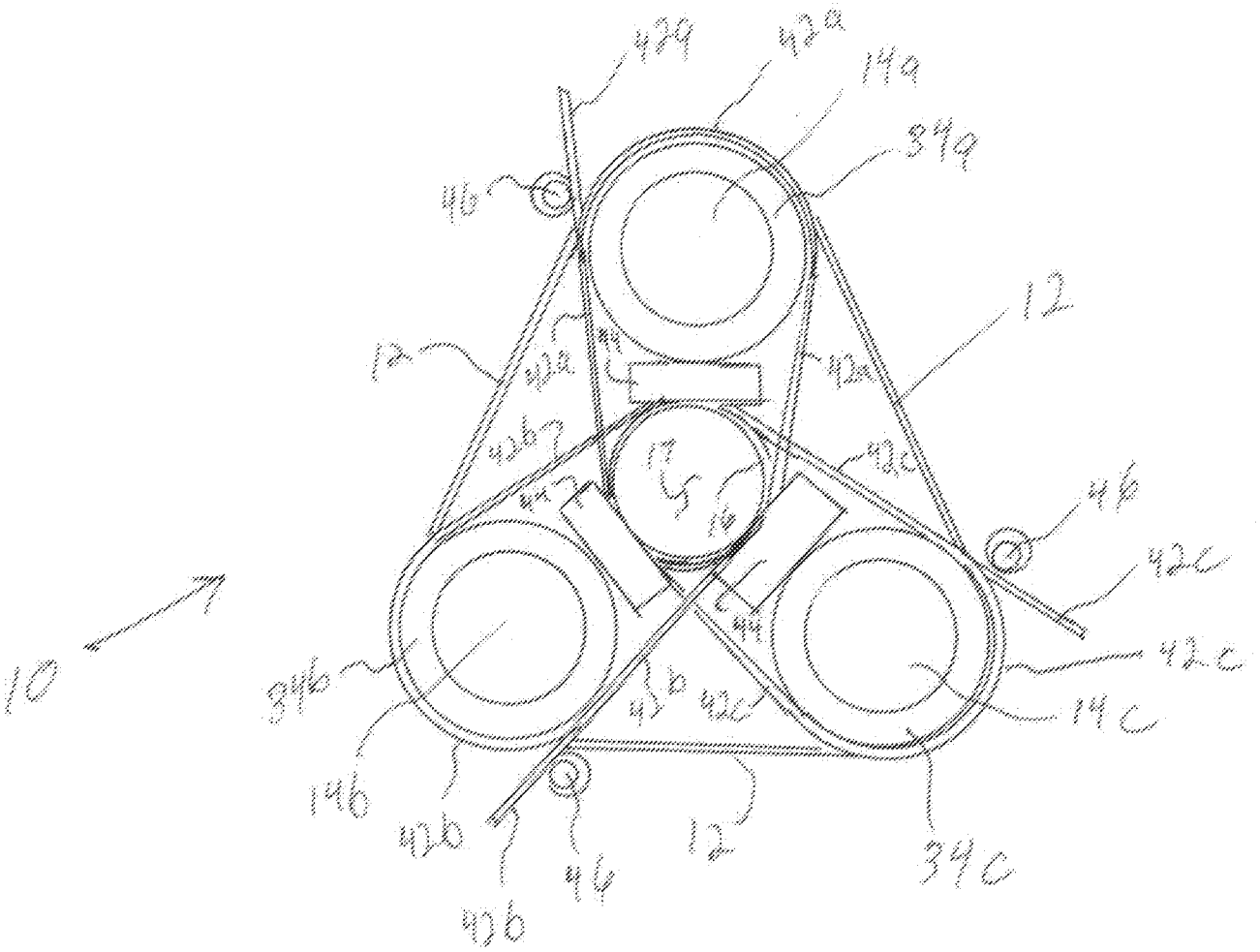
FIG. 3 is a right side elevation view of the flashlight device of FIG. 1 without an eyepiece attached.
Figure 4:
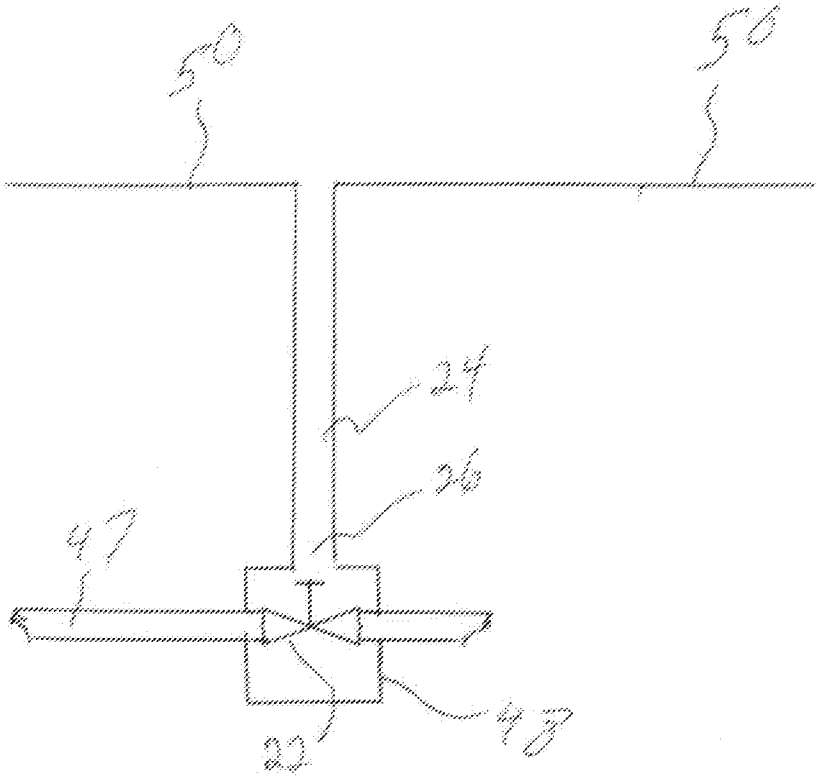
FIG. 4 is an underground view of a conduit providing manual access to an underground valve in accordance with the present invention.

Referring now to the figures, a flashlight device for observing objects in a distal end portion of a recess or conduit in accordance with the present invention is denoted as numeral 10. The device 10 includes an enclosure 12, a plurality of light bulbs or cylindrical flashlights 14 *a, b, c* (hereinafter 14) disposed in a substantially annular configuration within the enclosure 12, and a cylindrical sight tube 16 having a central aperture 17 therethrough. The sight tube 16 is centrally disposed within the annular configuration of flashlights 14 and extending longitudinally through the enclosure 12. The preferred embodiment of the device 10 includes three light emitting diode (LED) flashlights 14 having cylindrical configurations with the same dimensions, which includes substantially about a six inch axial dimension and a one inch diameter. One of many companies that manufacture the required flashlights 14 is JETbeam Flashlight. The model number for the flashlights 14 is PA20EDC. Irrespective or light bulbs or flashlights 14 being used in the device 10, all light emitting bulbs are powered by batteries (not depicted) having predetermined voltages and current capacity specifications.

The flashlights 14 are ultimately arranged and secured in a triangle configuration when taking an end elevation view of either end of the device 10. The sight tube 16 is manufactured from a light weight metal such as aluminum and includes a cylindrical configuration having an axial dimension relatively longer than the axial dimensions of the flashlights 14 and having a diameter substantially about one inch. The sight tube 16 is axially aligned with the flashlights 14 and centrally disposed within the annularly arranged flashlights 14 such that first ends 30 *a, b, c* (hereinafter 30) and 32 *a, b, c* (hereinafter 32) of the flashlights and sight tube 14 and 16 are arranged substantially planar when taking a front elevation view of the device, and second ends 34 *a, b, c* (hereinafter 34) and 36 *a, b, c* (hereinafter 36) of the flashlights and sight tube 14 and 16 are arranged such that the second ends 34 of the flashlights 14 are substantially planar while the second end 36 of the sight tube 16 protrudes beyond the second ends 34 of the flashlights 14, thereby providing sufficient exposed length to allow a magnifying eyepiece 18 to be integrally or detachably secured to the second end 36 of the sight tube 16. One or more focus members 20 ultimately secure the flashlights 14 about the sight tube 16. The focus members 20 also adjust the direction of the light emitted from the flashlights 14 such that the emitted light is focused upon an object 22 being observed when the device 10 is manually operated.

The magnifying eyepiece 18 of the device 10 is capable of magnifying the object 22 while protecting the eye of the user when the user operates the device 10. The device 10 allows a user to shine a light down a conduit configuration 24 and simultaneously view and magnify, via the eyepiece 18, a predetermined object 22 proximate to an end portion 26 of the conduit 24 while manually supporting the device 10. Many companies manufacture a magnifying eyepiece 18, but the preferred eyepiece 18 for the device 10 is manufactured by Nikon with part number DK-17M. The diameter dimensions of the sight tube 16 and eyepiece 18 cooperate to allow the eyepiece 18 to be readily secured to the second end 36 of the sight tube 16.

The enclosure 12 can be formed from a relatively small rigid box or from duct tape tightly wrapped about the flashlights 14 *a* sufficient number of times such that the flashlights 14 are rigidly secured together. Alternatively, the enclosure 12 can be replaced by one or more clamps that surround all flashlights 14, which surround the sight tube 16. Irrespective of the method used to form the enclosure 12 for the flashlights 14, the preferred outer configuration of the enclosure 12 includes a plurality of aligned recesses 28 that receive the users fingers to form a handgrip that allows the user of the device 10 to manually grasp and support the device 10 with one hand. The enclosure 12 includes a wrist strap 38 secured to a predetermined outer portion of the enclosure 12 such that the strap 38 forms a loop through which a user's hand passes such that the user's hand is allowed to grasp the enclosure 12 via the aligned recesses 28 while the strap 38 circumferentially engages a wrist portion of the user to prevent the enclosure 12 from falling to the ground in the event the user loses his or her grasp upon the enclosure 12.

The flashlights 14 forming an annular configuration can be replaced by a relatively large quantity of relatively small lights powered by at least one predetermined battery, or replaced by a relatively small quantity of relatively large lights powered by at least one predetermined battery. Irrespective of the size and quantity of lights used, the lights are annually configured and secured inside a first end of the enclosure 12 and wired to a battery via means well known to those of ordinary skill in the art. Further, the sight tube 16 and eyepiece 18 can be replaced by a relatively small telescope (not depicted), which includes an eyepiece, that is centrally disposed and secured to the flashlights 14 such that the flashlights 14 do not impede the telescope from being manually and axially extended by the user while the user manually supports the device 10.

The focus members 20 of the device 10 include manually operated first and second focus clamp members 40 *a, b, c* (hereinafter 40) and 42 *a, b, c* (hereinafter 42) for each flashlight 14 secured to the sight tube 16. The first and second clamp members 40 and 42 cooperate to radially urge corresponding first and second ends 30 and 34 of a predetermined flashlight 14 closer to or further from the central axis of the respective flashlight 14. Initially, all the flashlights 14 are disposed such that all central axes of the flashlights are parallel to the central axis of the sight tube 16, thereby directing the light emitted from each flashlight 14 substantially parallel down the conduit 24. In the event that the light emitted from one or more of the flashlights 14 needs to be angled down the conduit 24, respective first and second clamp members 40 and 42 for the selected flashlight 14 can be manually tightened or loosened to correspondingly direct the light emitted from the respective flashlight 14 inwardly toward or outwardly from the axis of the flashlight 14 to enable the user to shine a flashlight down a conduit configuration 24 and simultaneously view and illuminate the predetermined object 22 proximate to an end portion 26 of the conduit 24 while the device 10 is manually supported.

The first and second clamp members 40 and 42 are employed for radially moving corresponding first and second ends 30 and 34 of the respective flashlight 14 via a cooperating resilient, deformable biasing member 44 disposed between each first and second end 30 and 34 of each flashlight 14 and each cooperating portion of the first and second ends 32 and 36 of the sight tube 16. The first and second clamp members 40 and 42 together with the biasing member 44 comprise the focus member 20. The biasing member 44 is fabricated from relatively "stiff" piece of arcuate rubber well known to those of ordinary skill in the art. The biasing member 44 is ultimately deformed to congruently engage cooperating portions of the cylindrical sight tube 16 and an adjacent flashlight 14. The position of the respective biasing member 44 is maintained by a cooperating first clamp member 40 or a second clamp member 42 forcibly urging a corresponding first end 30 or a second end 34 of the respective flashlight 14 upon the respective biasing member 44, whereupon, the respective biasing member 44 is compressed or otherwise squeezed against a corresponding outer cylindrical wall portion of the first end 32 or the second end 36 of the sight tube 16. The first and second clamp members 40 and 42 are tightened or loosened about the sight tube 16 and a respective flashlight 14 by correspondingly rotating a securing screw 46 integrally joined to the clamp members 40 and 42.

In operation, the device 10 enables a person to view down a relatively long conduit 24 having a relatively small lateral dimension to ultimately view an object 22 positioned proximate to an end portion 26 of the conduit 24. For example, underground water lines 47 providing water to residential dwellings are open and closed via valves 22 in enclosures typically referred to as "Buffalo Box" 48. To access a Buffalo Box 48 and to operate a water valve 22 therein, a person uses a hand tool (not depicted) to extend from ground level 50 down an access pipe 24 having a relatively small diameter and into the Buffalo Box 48 to open or close the water valve 22. A flashlight is required to illuminate the valve 22 to enable a person to see a valve actuator that is ultimately engaged by the hand tool to open or close the water valve 22. Because the access pipe 24 has a small diameter, it is difficult for the person holding the access tool in one hand and a flashlight in the other hand to see the valve 22 at the end portion 26 of the pipe 24 due to the flashlight blocking the person's vision as he or she attempts to engage the valve 22 with the hand tool.

The present device 10 allows the person to illuminate the valve 22 by first manually focusing one or more of the three flashlights 14 upon the valve 22, then view a magnified valve 22 via the eyepiece and cooperating sight tube 16 while holding the device 10. The central position of the sight tube 16 relative to the flashlights 14 enables the person to constantly view the valve 22 so long as at least one of the flashlights 14 illuminates the valve 22. The magnified valve 22 simplifies the process of the person engaging the hand held tool with the valve actuator, thereby reducing the time required to open or close the valve 22.

Figure 5:
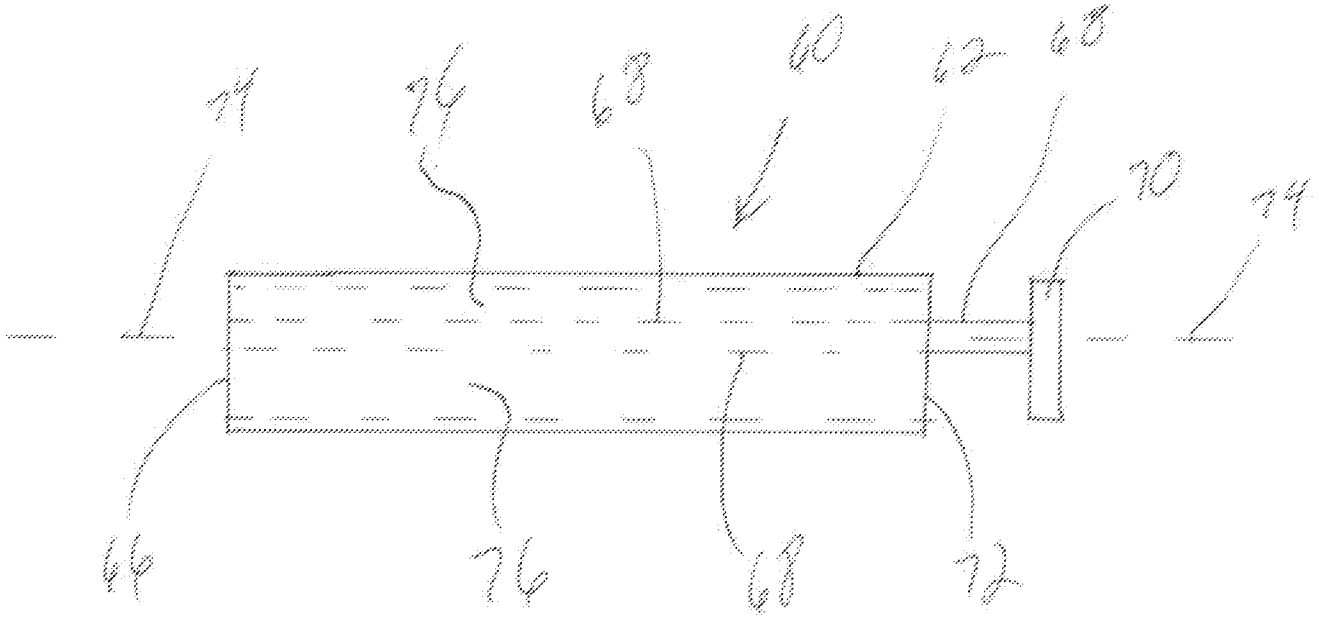
FIG. 5 is a front elevation view of an alternative embodiment of the flashlight device in accordance with the present invention.
Figure 7:
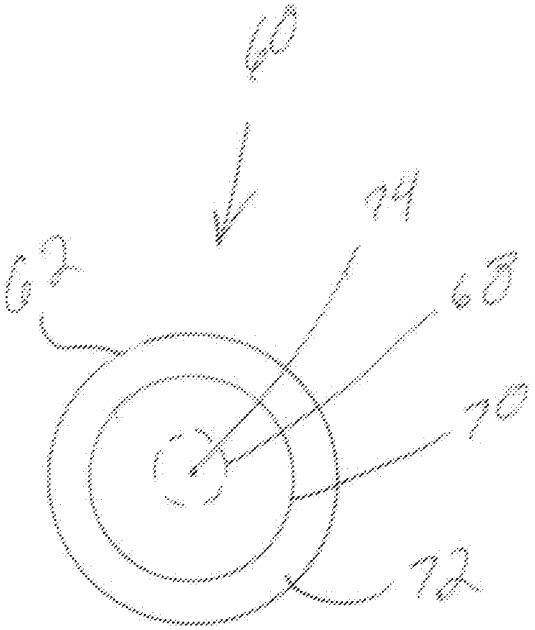
FIG. 7 is a right side elevation view of the flashlight device of FIG. 5.
Figure 8:
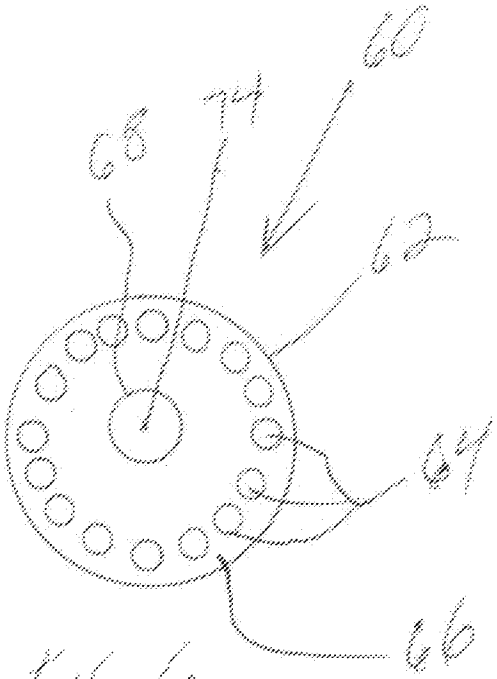
FIG. 8 is a front perspective view of an alternative flashlight device in accordance with the present invention.
Figure 8:
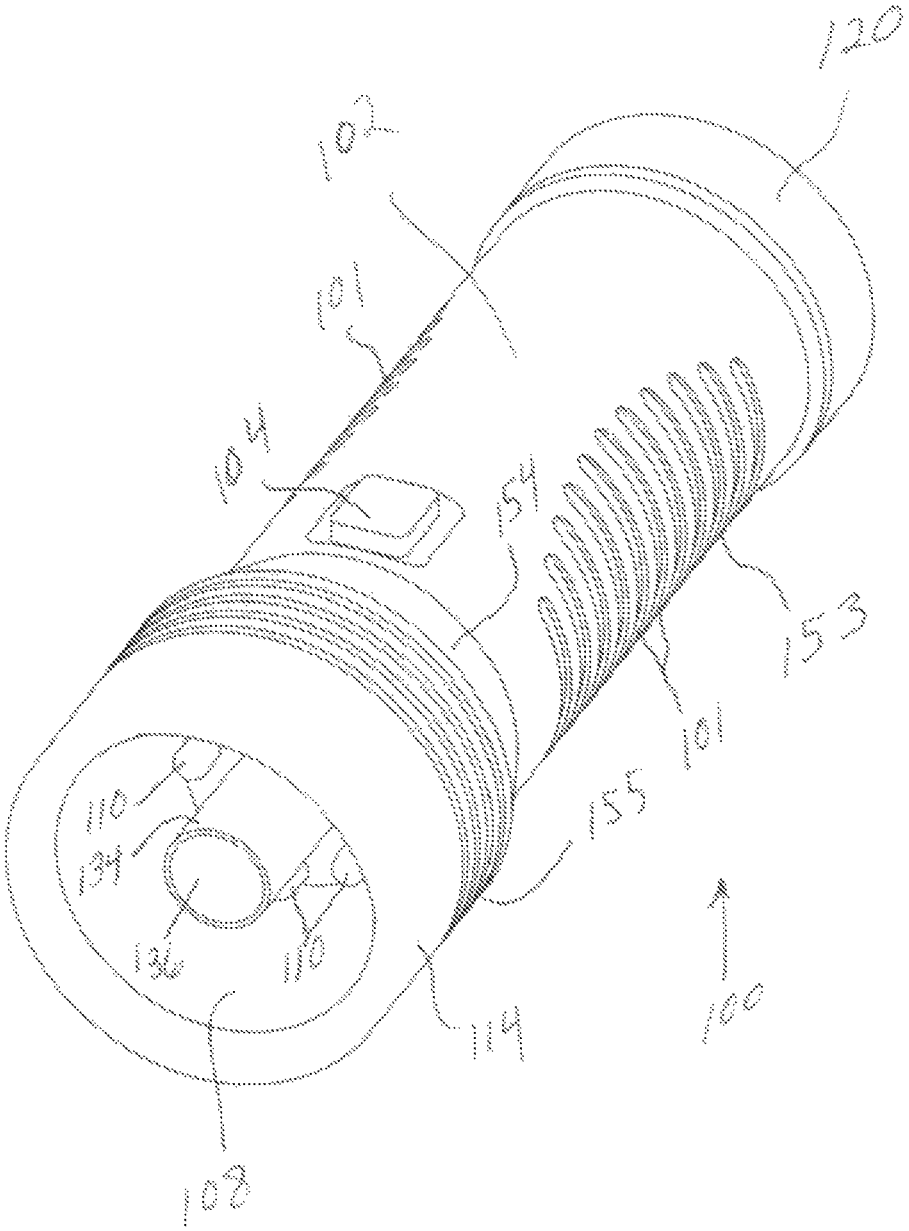
Figure 9:
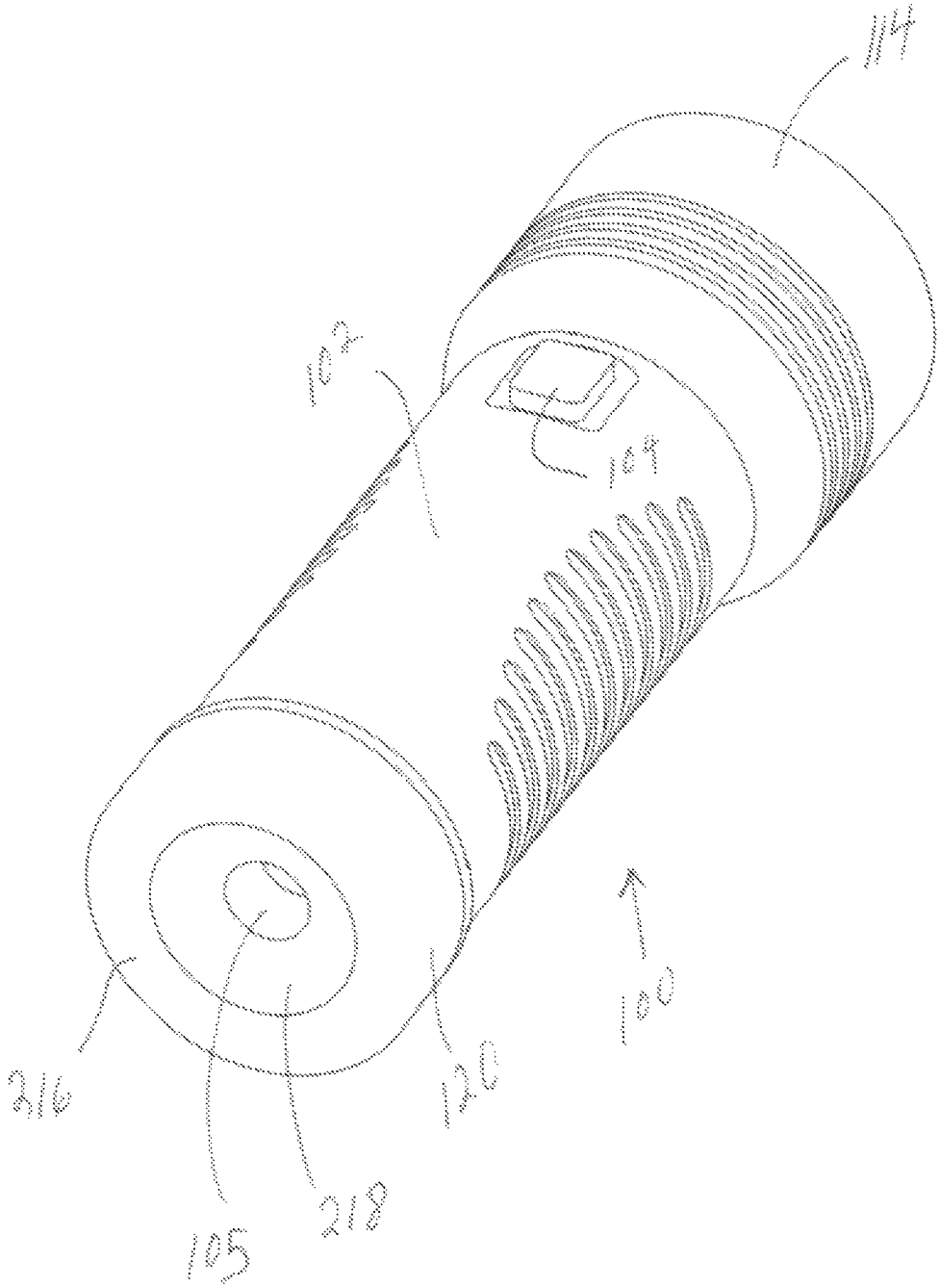
FIG. 9 is a back perspective view of the alternative flashlight device of FIG. 8.
Figure 10:
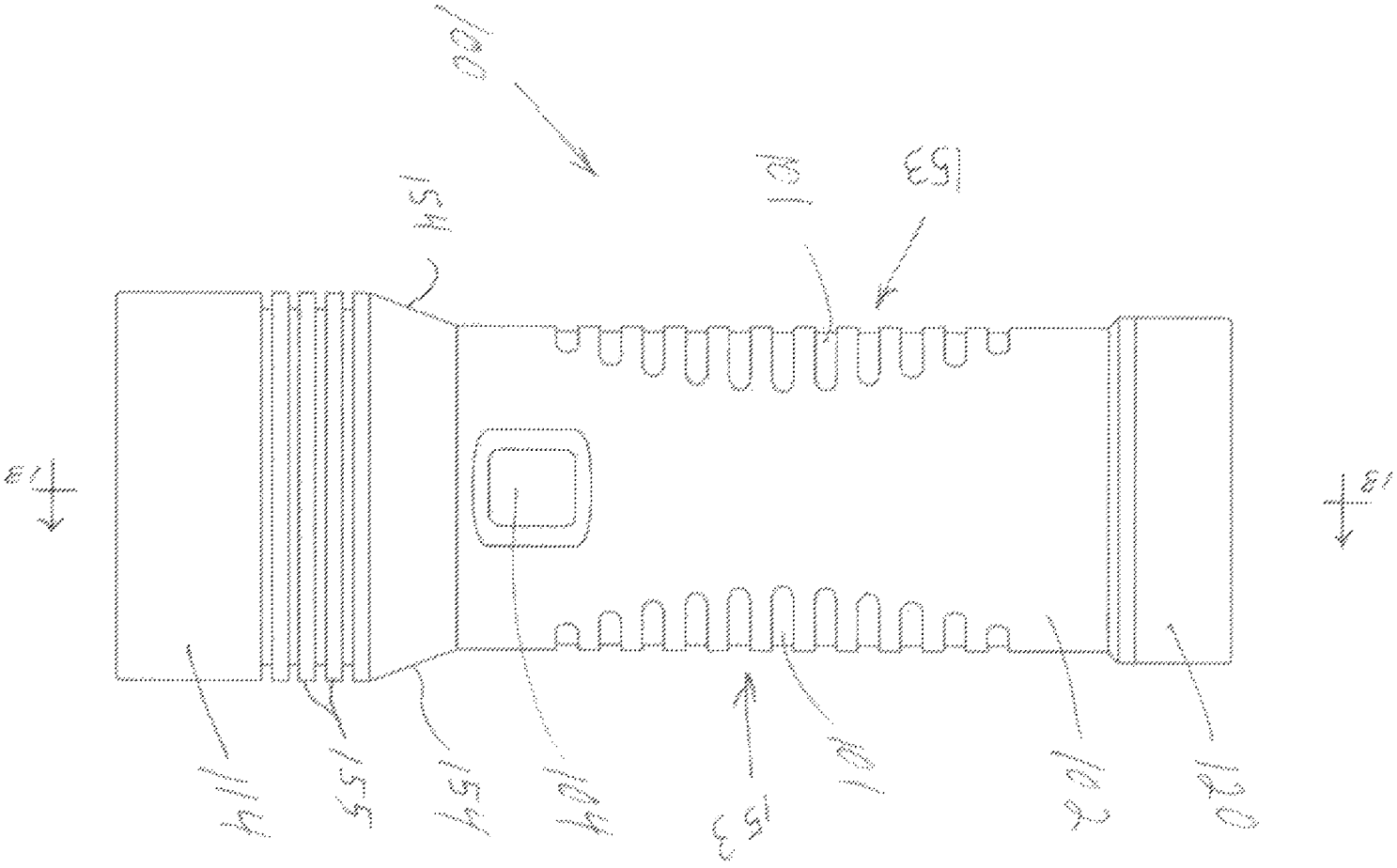
FIG. 10 is a top elevation view of the alternative flashlight device of FIG. 8.
Figure 11:
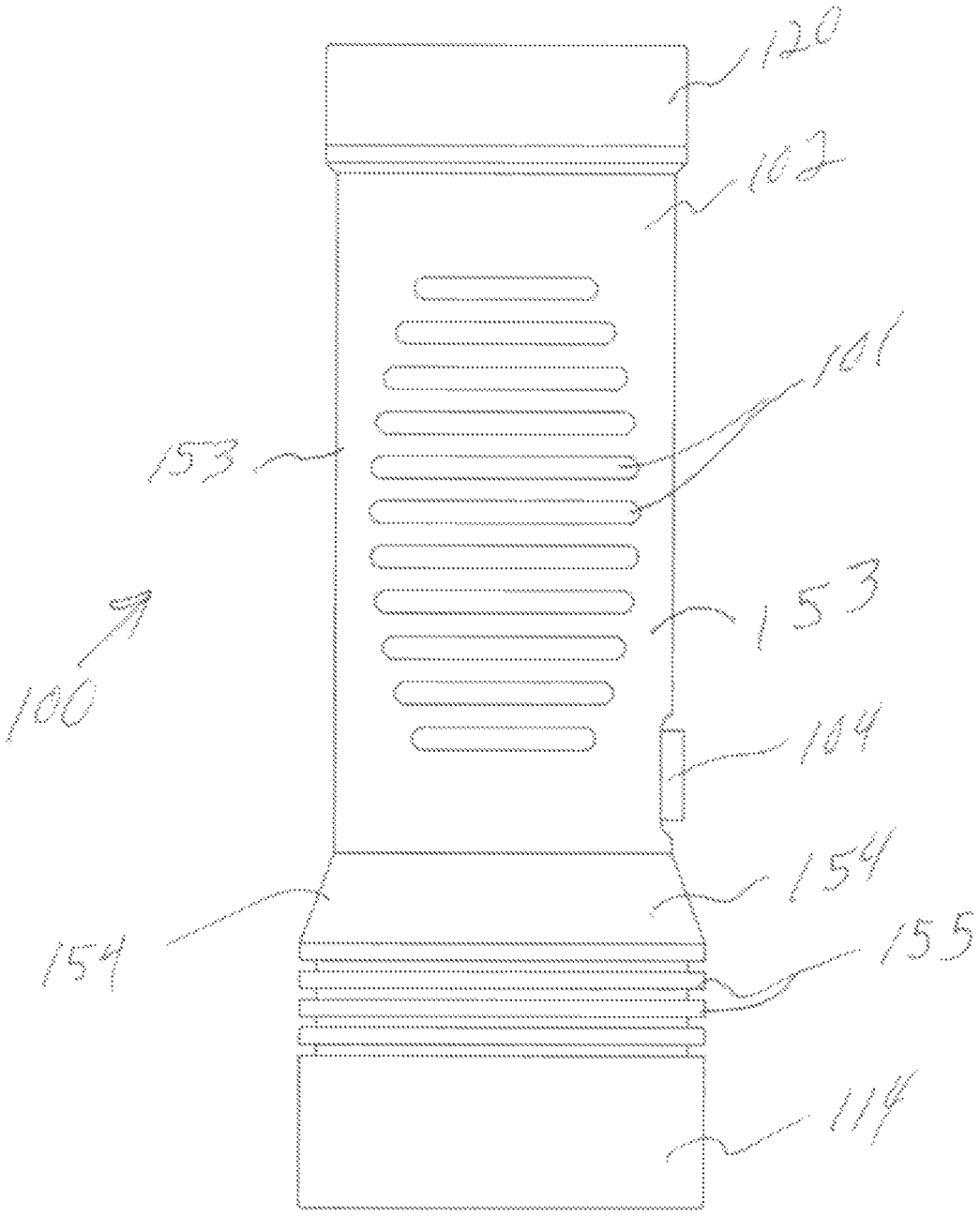
FIG. 11 is a left side elevation view of the alternative flashlight device of FIG. 10.
Figure 12:
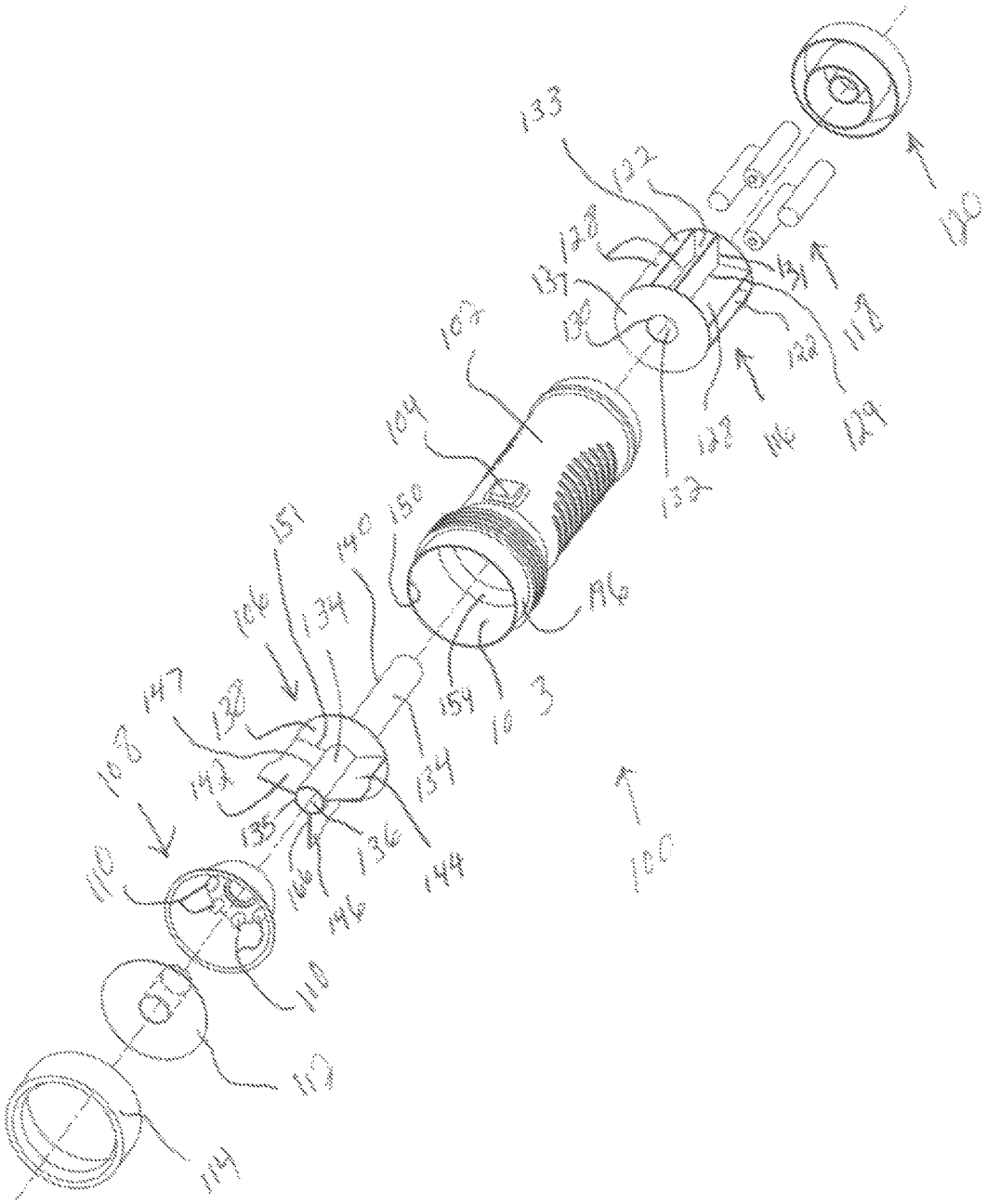
FIG. 12 is an exploded front perspective view of the alternative flashlight device of FIG. 8.
Figure 13:
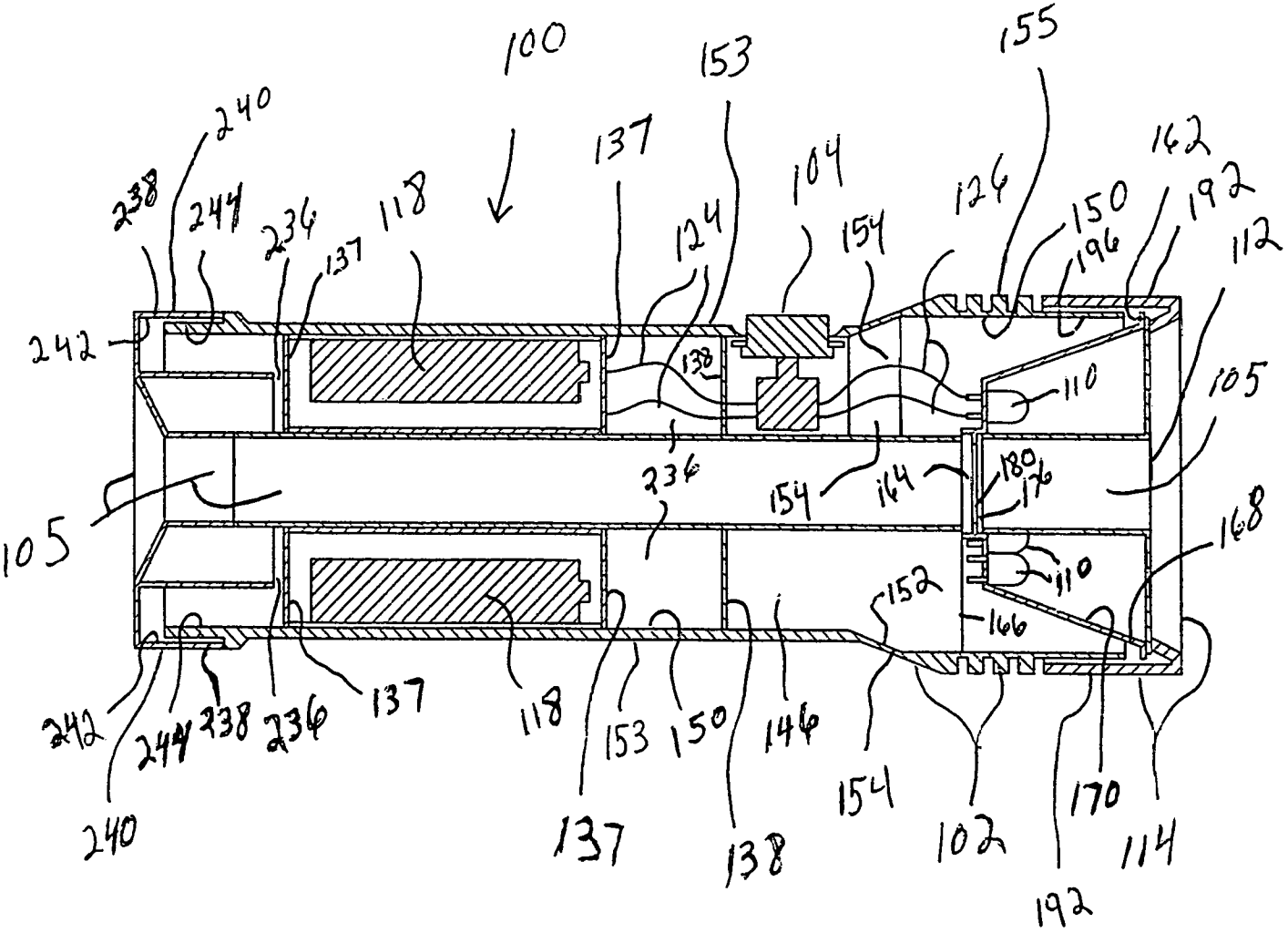
FIG. 13 is sectional view taken along line 13-13 of FIG. 10 exposing the internal components of the alternative flashlight device in accordance with the present invention.
Figure 14:
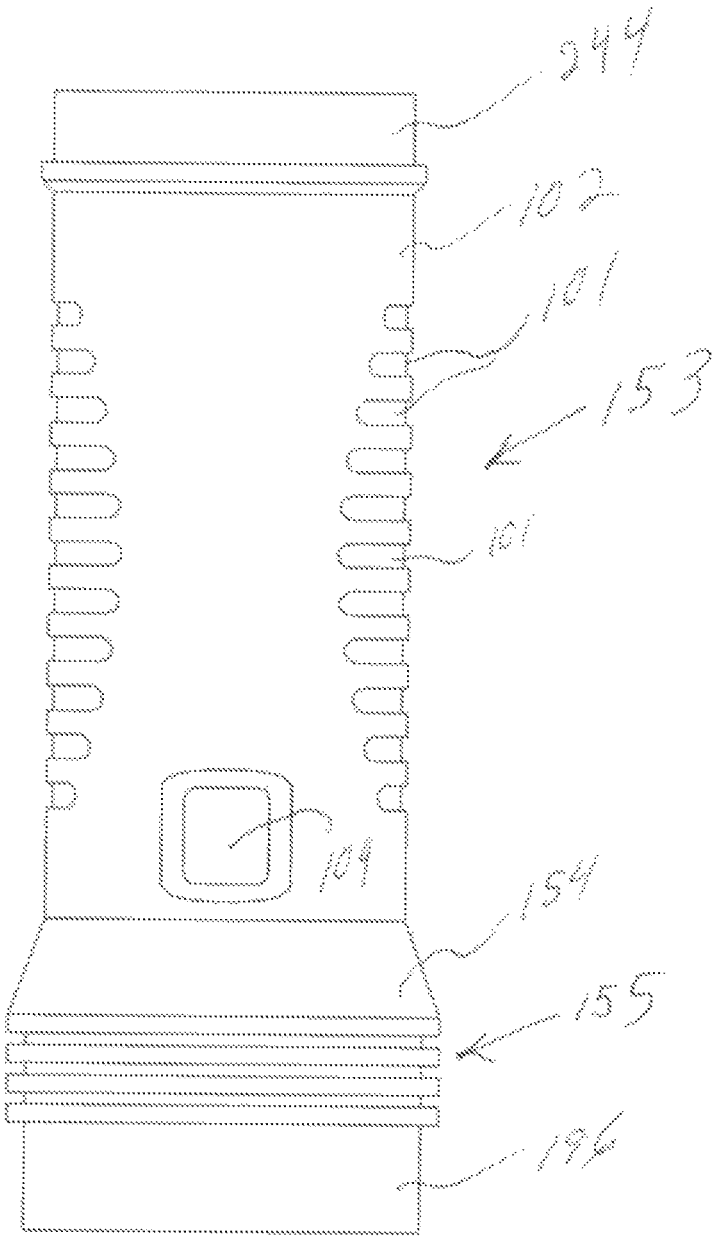
FIG. 14 is the top elevation view of FIG. 10, but with the front and back end covers removed in accordance with the present invention.
Figure 15:
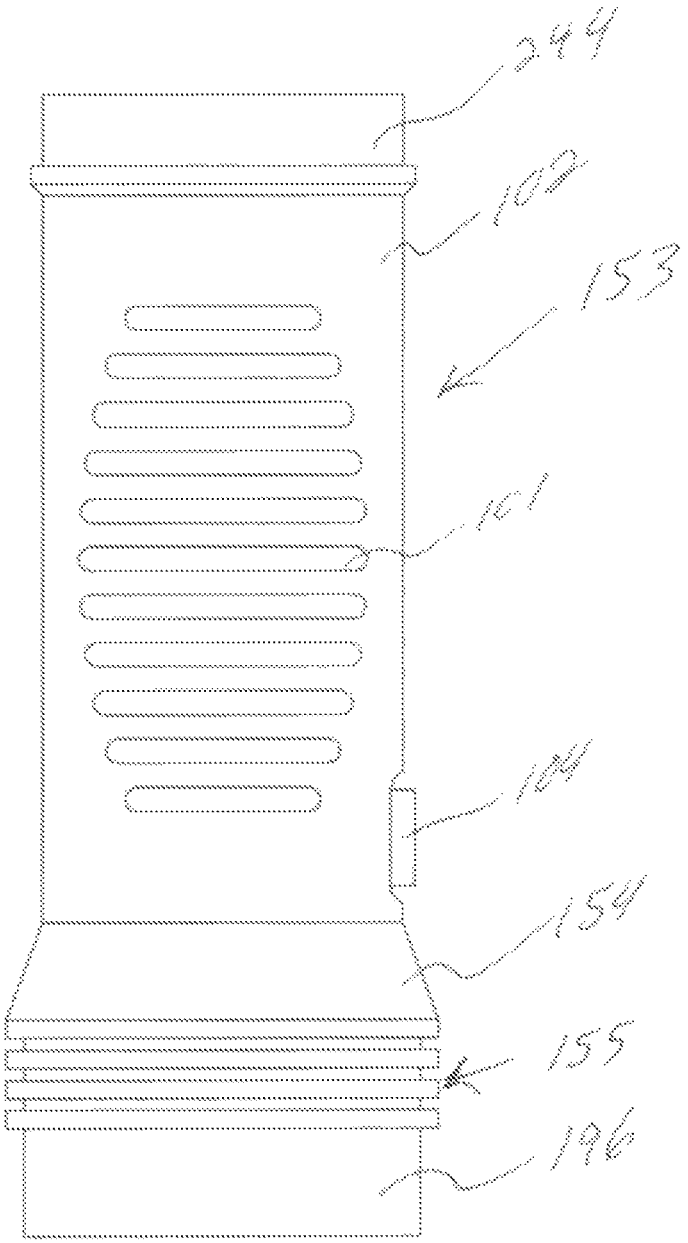
FIG. 15 is the left side elevation view of FIG. 11, but with the front and back end covers removed.
Figure 16:
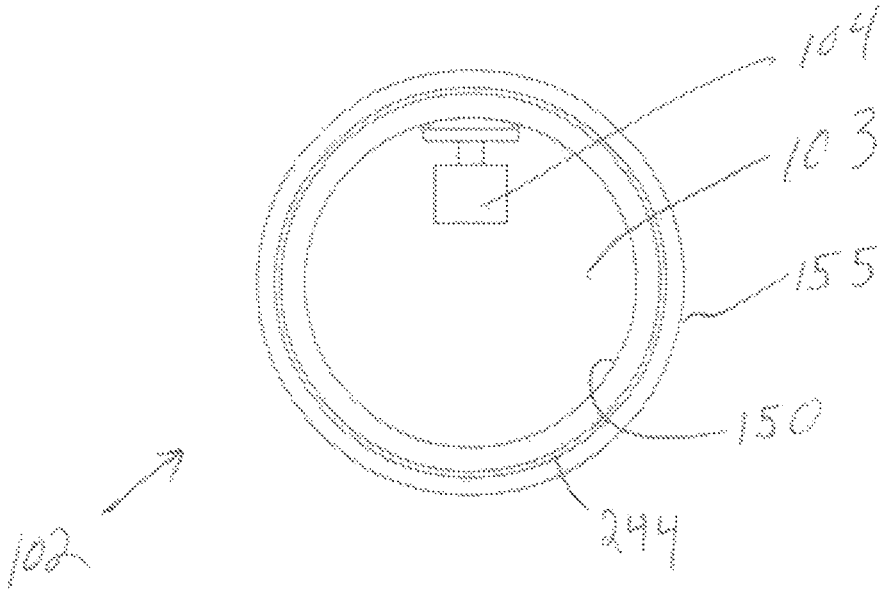
FIG. 16 is a front elevation view of the alternative flashlight device of FIG. 14.
Figure 17:
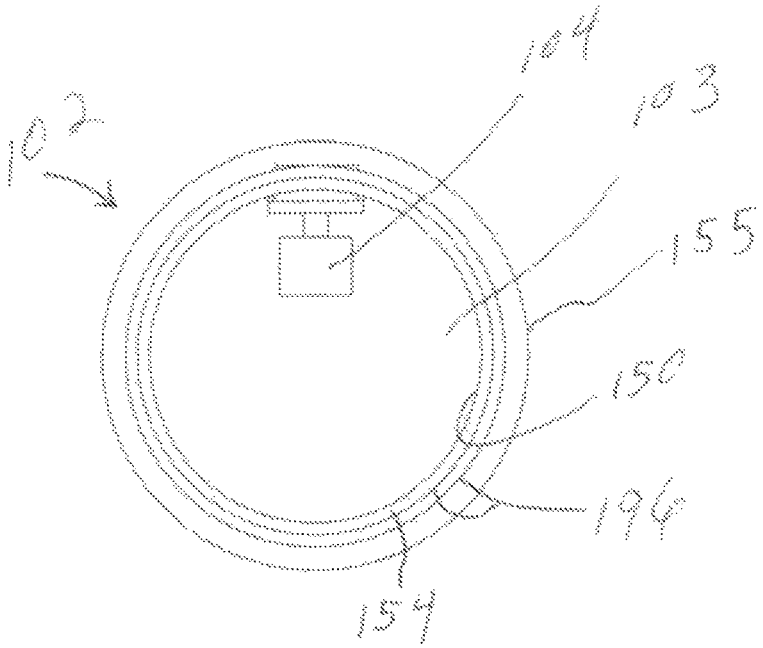
FIG. 17 is a back elevation view of the alternative flashlight device of FIG. 14.
Figure 18:
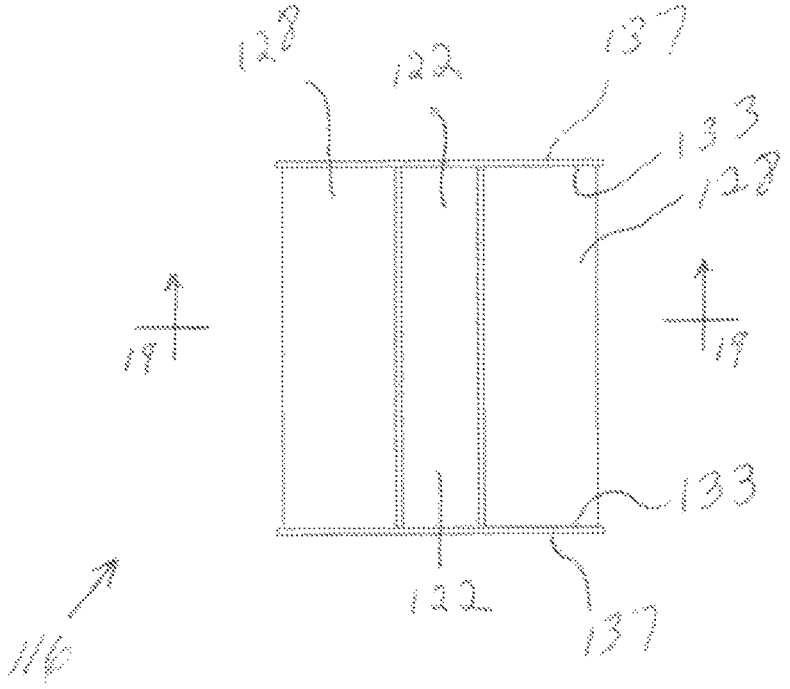
FIG. 18 is a top elevation view of a battery retainer of the alternative flashlight device of FIG. 12 in accordance with the present invention.
Figure 19:
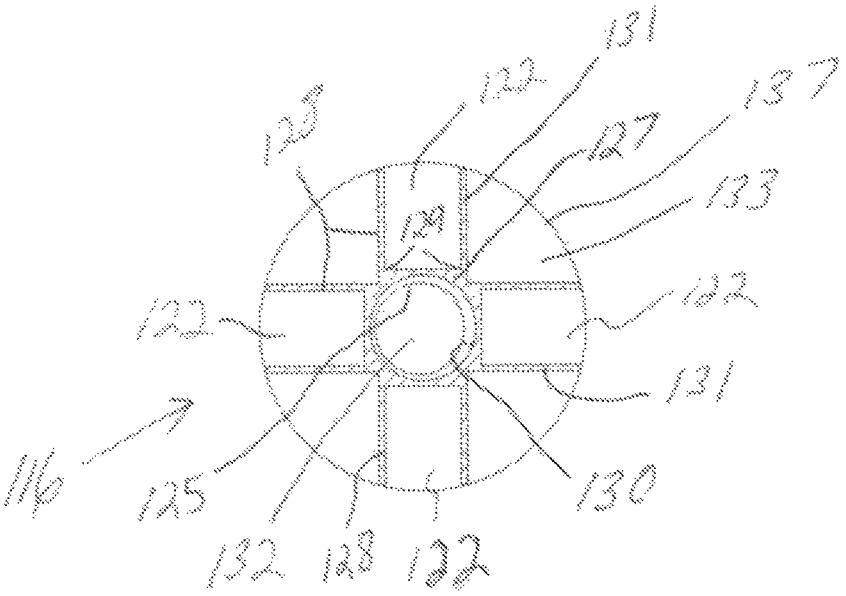
FIG. 19 is a front sectional view taken along line 19-19 of the battery holder of FIG. 18.
Figure 20:
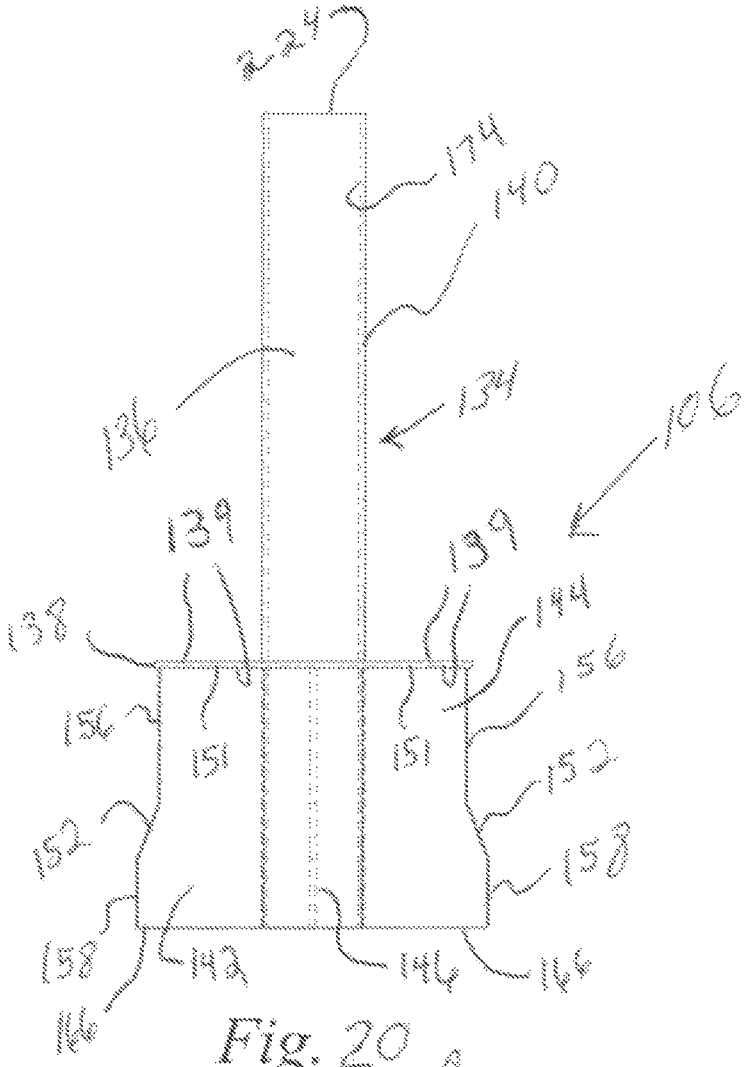
FIG. 20 is a top elevation view of a spacer of the alternative flashlight device of FIG. 12 in accordance with the present invention.
Figure 21:
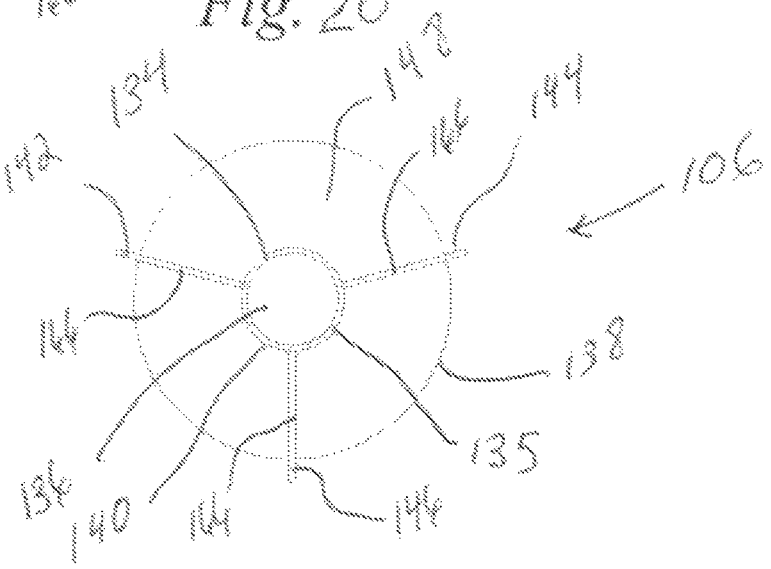
FIG. 21 is front elevation view of the spacer of FIG. 20.
Figure 22:
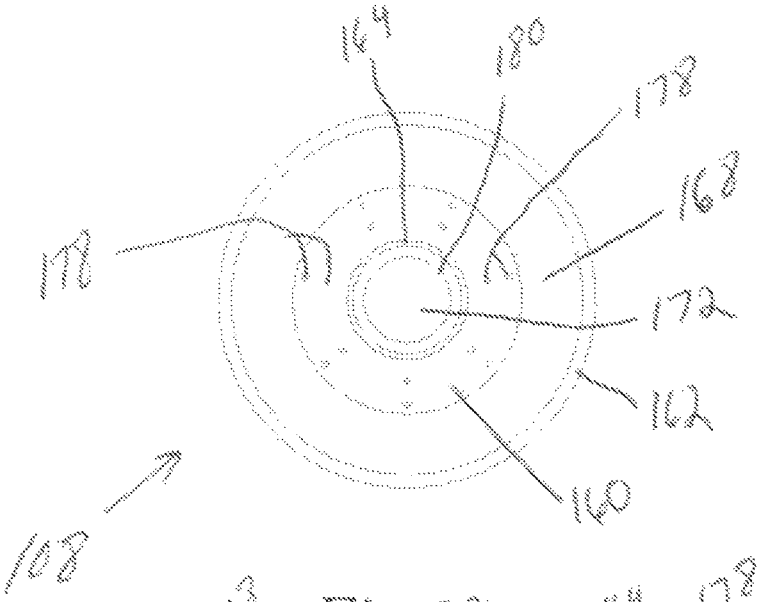
FIG. 22 is a back elevation view of a light reflector of the alternative device of FIG. 12 in accordance with the present invention.
Figure 23:
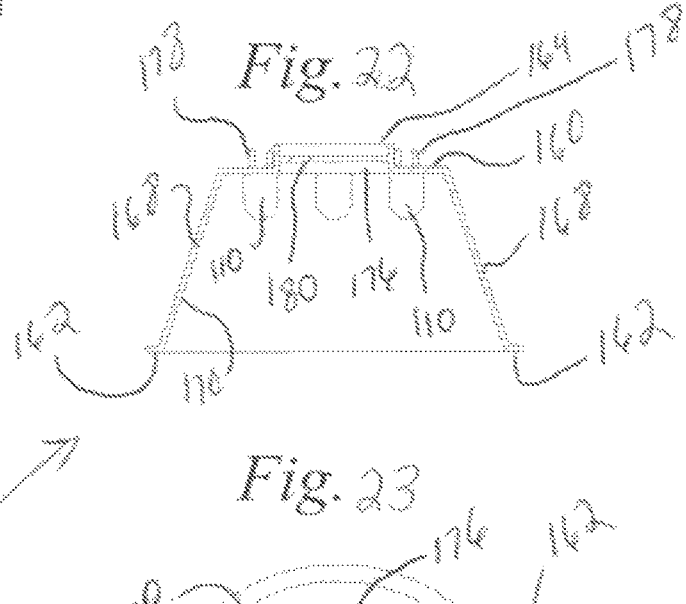
FIG. 23 is a top elevation view of the light reflector of FIG. 22.
Figure 24:
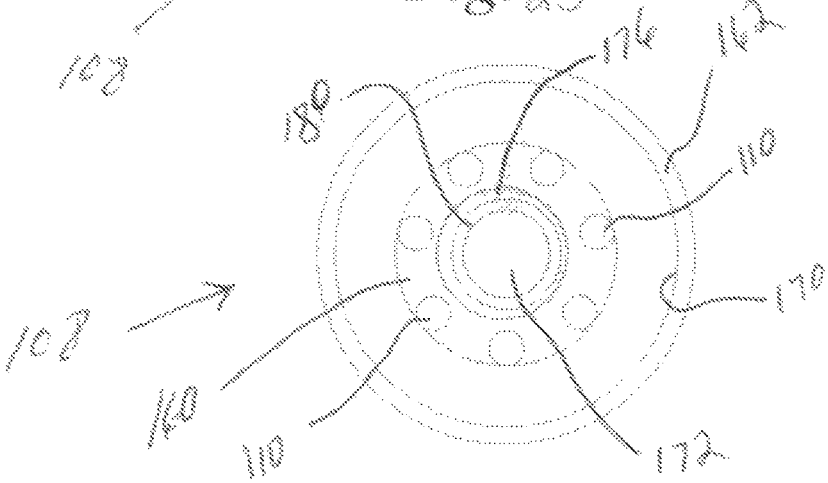
FIG. 24 is a front elevation view of the light reflector of FIG. 22.
Figure 25:
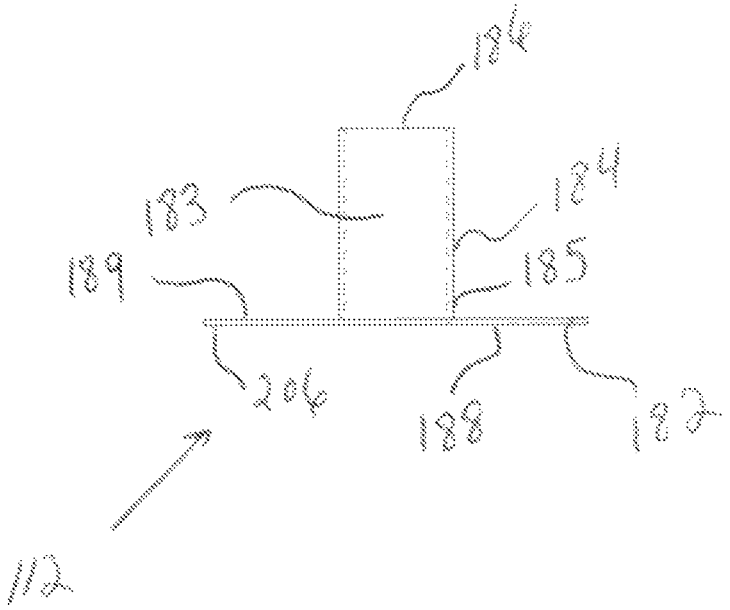
FIG. 25 is a top elevation view of a shield member of the alternative device of FIG. 12 in accordance with the present invention.
Figure 26:
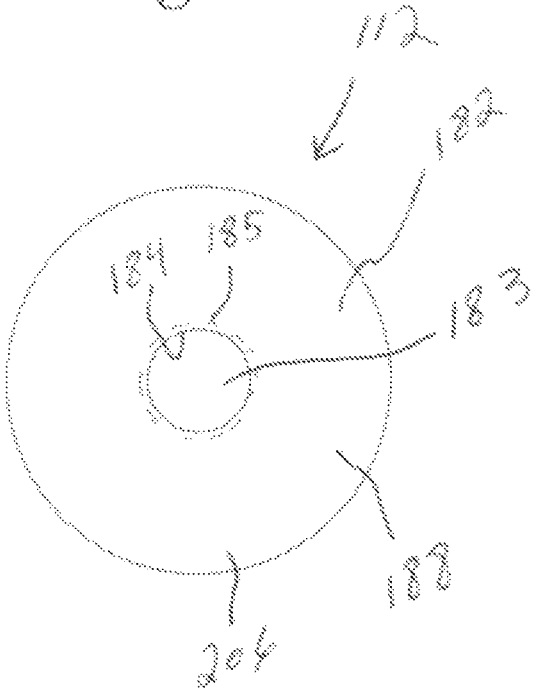
FIG. 26 is a front elevation view of the shield member of FIG. 25.

Referring now to FIGS. 5-7, an alternative embodiment of the flashlight device is denoted as numeral 60. The alternative flashlight device 60 includes a flashlight enclosure 62, a plurality of relatively small light bulbs 64 annularly disposed at a first end 66 of the flashlight enclosure 62, a sight tube 68 centrally disposed and longitudinally extending through the enclosure 62, and an eyepiece 70 detachably secured to an end portion of the sight tube 68 protruding through a second end 72 of the enclosure 62.

The enclosure 62 can be fabricated from metal, plastic or similar rigid material capable of maintaining a predetermined configuration when the flashlight device 60 is manually operated. The enclosure 62 and light bulbs 64 in the first end 66 of the enclosure 62 are substantially similar to a light emitting diode (LED) flashlight sold by "Overstock" on line store. The flashlight is identified as "Item #11518753" and includes a six inch long housing with 42 LEDs and six AAA batteries for energizing the LEDs. The Overstock flashlight or a similar flashlight is used the fabricate the alternative device 60 by removing LEDs disposed in a center portion of the flashlight, thereby leaving a sufficient number of LEDs or light bulbs 64 (approximately fifteen) about the periphery of the first end 66 of the enclosure 62 to illuminate the conduit 24. The removed light bulbs provide sufficient space to insert the sight tube 68 through a central portion of the enclosure, although the sight tube 68 can be offset from the central axis 74 of the enclosure 62 so long as the sight tube 68 remains parallel to the central axis 74, thereby allowing a person looking through the sight tube 68 to view an object 22 being illuminated by the light bulbs 64. The positioning of the sight tube 68 parallel to but distally from the central axis 74 provides a cavity 76 configuration inside the enclosure 62 that allows the enclosure to receive a myriad of battery configurations that can be used to energize the light bulbs 64.

The sight tube 68 and eyepiece 70 can be the same size and fabricated from the same material as the corresponding sight tube 16 and eyepiece 18 of the flashlight device 10 above. Alternatively, the sight tube 68 and eyepiece 70 can be relatively smaller in size when compared to the dimensions of the alternative flashlight 60, thereby reducing the effort required when a person operates the device 60 with one hand. The position of the sight tube 68 and batteries (not depicted) relative to the enclosure 62 are maintained by means well known to those of ordinary skill in the art. Further, the electrical connections between the batteries and light bulbs 64 are achieved by means well known by those of ordinary skill in the art.

Referring now to FIGS. 8-33 and in particular to FIGS. 8-17, an alternative flashlight device having a viewing aperture in accordance with the present invention is denoted as numeral 100. The flashlight 100 includes an enclosure 102 with handgrips 101 and a manually operated switch 104 secured to a top portion of the enclosure 102, a spacer member 106, a light reflector 108 having a plurality of lights or lamps 110 therein, a shield member 112, a front end cover 114, a battery retainer 116, a plurality of batteries 118 and a back end cover 120. The enclosure 102 and all the non-electrical cooperating components can be manufactured from a myriad of materials including, but not limited to plastic, steel, graphite, aluminum, stainless steel and combinations thereof. The enclosure 102 includes a typical cylindrical configuration with a central aperture 103 dimensioned to receive predetermined components that result in a flashlight 100 having a preselected lighting capability, together with a centrally disposed longitudinally orientated viewing aperture 105 that enables a person to illuminate a confined space, such as a relatively long conduit, and view that confined space by looking through the viewing aperture 105 while holding the back end cover 120 proximate to his or her eye.

Referring to FIGS. 12, 13, 18 and 19, the battery retainer 116 includes a plurality of battery slots 122 configured and dimensioned to snugly receive and retain cooperatively configured and dimensioned batteries 118 via spring and contact members, not depicted but well known to those of ordinary skill, that engage and electrically connect corresponding positive terminals and negative end portions of the batteries 118 to electrical wires 124 to ultimately energize the lights 110 in the light reflector 108. The preferred lights 110 are 6 volt white light emitting diodes ("LEDs") with power ratings relative to the illumination required by the user. The LEDs are available on the "ebay" website and are well known to those of ordinary skill in the art. For the invention illustrated in FIGS. 7 and 8, four standard 1.5 volt batteries 118 are depicted that are series connected to the switch 104 via wires 124 to provide six volts via wires 126 to each of the lights 110, which are connected in parallel. The wires 124 include a length sufficient to allow the battery retainer 116 to be removed from the enclosure 102 with the wires connected to the switch 104. The wires 124 can be soldered to the switch 104 or can be removably connected to the switch 104 to allow the battery retainer 116 to be switched with a battery retainer 116 having batteries that energize the lights 110 for longer time periods. The switch 104, batteries 118 and all connections are well known to those of ordinary skill in the art.

The battery slots 122 are formed via longitudinal edges 129 of planar walls 128 longitudinally secured via adhesives 127 to an outer wall of cylindrical tube 130, and lateral edges 131 of the planar walls 128 being secured to inner cylindrical walls 133 of opposing end washers 137, such that the longitudinal edges 129 of the planar walls 128 are parallel to the longitudinal axis of a central aperture 132 that extends through the battery retainer 116, the aperture 132 being defined by an inner cylindrical wall 125 of the tube 130. Although the preferred embodiment includes four 1.5 volt batteries 118, the scope of the present invention can include one or more batteries having voltage and current ratings that energize the lights 110 selected for the intended use of the flashlight 100. The number of batteries ultimately selected would require a corresponding quantity of planar walls 128 configured and dimensioned to secure the position of the batteries in the battery retainer 116.

Referring to FIGS. 12, 13, 20 and 21, the spacer member 106 includes a cylindrical sight tube 134 with an aperture 136 therethrough and a relatively "thin" cylindrically configured base member 138 with opposing planar walls 139 that is integrally and radially joined to an outer wall 140 of the tube 134 at substantially about one-third the longitudinal distance from a front end 135 of the tube 134. The spacer member 106 further includes first and second side positioning walls 142 and 144, and a bottom positioning wall 146. The positioning walls 142, 144 and 146 are integrally secured to the outer wall 140 of the cylindrical tube 134 via lineal longitudinal edge portions 147 of each of the positioning walls. The edge portions 147 are secured longitudinally parallel to the central longitudinal axis of the tube 134 such that a lateral axis of each lineal edge portion 147 perpendicularly intersects the central longitudinal axis of the tube 134 similar to feathers attached to the shaft of an arrow.

The positioning walls 142, 144 and 146 ultimately maintain the lateral position of the spacer member 106 relative to the enclosure 102 after the spacer member 106 is inserted into the enclosure 102 a predetermined lineal distance. The angle between the first side and bottom positioning walls 142 and 146 is substantially about one hundred and five degrees, and the angle between the second side and bottom positioning walls 144 and 146 is also substantially about one hundred and five degrees, resulting in an angle between the first and second side positioning walls 142 and 144 of substantially about one hundred and fifty degrees. The larger angle separating the first and second side positioning walls 142 and 144 promotes an upper recess 148 between the spacer member 106 and an inner wall 150 of the enclosure 102 that allows the insertion of the switch 104 into the enclosure 102, and the wires 126 to be routed and connected to the switch 104 and the lights 110, such that the switch 104 energizes and de-energizes all lights 110 connected in parallel and disposed in the light reflector 108.

The cylindrically configured base member or washer 138 is integrally secured to lineal lateral inner edges 151 of the positioning walls 142, 144 and 146. The washer 138 is dimensioned and cylindrically configured to insert into the enclosure 102 until angle edge portions 152 of each of the three side positioning walls 142, 144 and 146 engage a cooperating angle wall portion 154 of the inner wall 150 of the enclosure 102 that restricts further axial movement of the spacer 106 into the enclosure 102, whereupon, the washer 138 is snugly inserted into a battery section 153 of the flashlight 100 having a diameter relatively smaller than the diameter of a light section 155 of the flashlight 100. The angle edge portions 152, when engaging wall portion 154, cooperate with the position walls inner and outer longitudinal edges 156 and 158, which engage corresponding longitudinal portions of the inner wall 150 of the battery section 153 and light section 155, respectively, to laterally maintain axial alignment of the central longitudinal axis of the cylindrical tube 134 with the central longitudinal axis of the enclosure 102 irrespective of the orientation of the flashlight 100.

Referring to FIGS. 12, 13, and 22-24, the light reflector 108 is frusto-conically configured and includes an inner annular wall 160 having an outer diameter about two-thirds the outer diameter of an outer annular wall 162, and axially aligned with and distally displaced from the outer wall 162 such that an inner engagement member 164 contacts outer edge portions 166 of the positioning walls 142, 144 and 146, thereby preventing further insertion of the light reflector 108 into the enclosure 102. The outer annular wall 162 includes an inner diameter slightly smaller than the outer diameter of the wall 162, resulting in a relatively "thin" edge or "lip" portion having a radial dimension sufficient to engage a cooperating portion of the shield member 112 to prevent the shield member 112 from longitudinally inserting into the enclosure 102 past a predetermined distance. The inner and outer annular walls 160 and 162 define a conically configured wall 168 having an inner reflective surface 170 that directs light through the shield member 112 to illuminate a preselected object (not depicted). The inner annular wall 160 includes a central orifice 172 axially aligned with and having a diameter slightly smaller than the inner cylindrical wall 174 of the cylindrical tube 134.

The central orifice 172 is defined by an inner extension member 176 configured and dimensioned the same as the inner engagement member 164 to separate the inner engagement member 164 from the inner wall 160 a distance greater than the length of light terminals 178 to prevent the outer edges 166 of the positioning walls 142, 144 and 146 from engaging and damaging the light terminals 178 an/or "short circuiting" the batteries 118. Although the preferred embodiment includes lights or lamps 110 annually configured about the orifice 172 to provide a more uniform illumination of an object, a single lamp relatively larger than the lamps 110 specified previously can be used for illumination purposes, but a single larger lamp 110 would cause either the single lamp 110 or the viewing aperture 105 to be offset from axial alignment with the light reflector 108, thereby reducing the uniform illumination of the object and would also cause increased "glare" or reflected light that would obstruct the user's view of the object. A separation portion 180 is formed between the inner engagement member 164 and the inner extension member 176 that includes an aperture axially aligned with and equal in diameter to the orifice 172 in the inner wall 160, both diameters being relatively smaller than the identical diameters of the engagement member 164 and extension member 176, thereby allowing the end of the cylindrical tube 134 to removably insert into inner engagement member 164 such that the end of the cylindrical tube 134 maintains the axial position of the light reflector 108 relative to the tube 134 via an inner portion of the separation portion 180 engaging the end of the tube 134 as the light reflector 108 is inserted into the enclosure 102.

Referring to FIGS. 12, 13, 25 and 26, the shield member 112 includes an annular transparent lens portion 182 having opposing planar outer and inner annular walls 188 and 189, and a central aperture 183 defined by an inner end portion 185 of a cylindrical tube portion 184 integrally and perpendicularly joined to the lens portion 182 such that the central axis of the tube portion 184 intersects the center of the lens portion 182. Although the preferred embodiment of the transparent lens portion 182 includes a central aperture 183, alternatively, a lens portion 182 without the aperture 183 can be used, but the view of the user will be distorted when attempting to view an object illuminated by the flashlight device 100. The tube portion 184 has an axial or longitudinal dimension that results in an end portion 186 of the tube portion 184 engaging a surface portion of the inner extension member 176. The outer diameter of the lens portion 182 is relatively greater than the inner diameter of the outer wall 162 of the light reflector 108, and relatively smaller than the outer diameter of the outer wall 162. The outer diameter of the lens portion 182 and the longitudinal dimension of the tube portion 184, results in the lens portion 182 engaging the outer wall 162 of the light reflector 108, and the end portion 186 engaging the inner extension member 176; thereby maintaining axial alignment between the tube portion 184 of the shield member 112, the light reflector 108, and the cylindrical tube 134 of the spacer 106 to maximize the user's view of the object being illuminated by the flashlight device 100.

Figure 27:
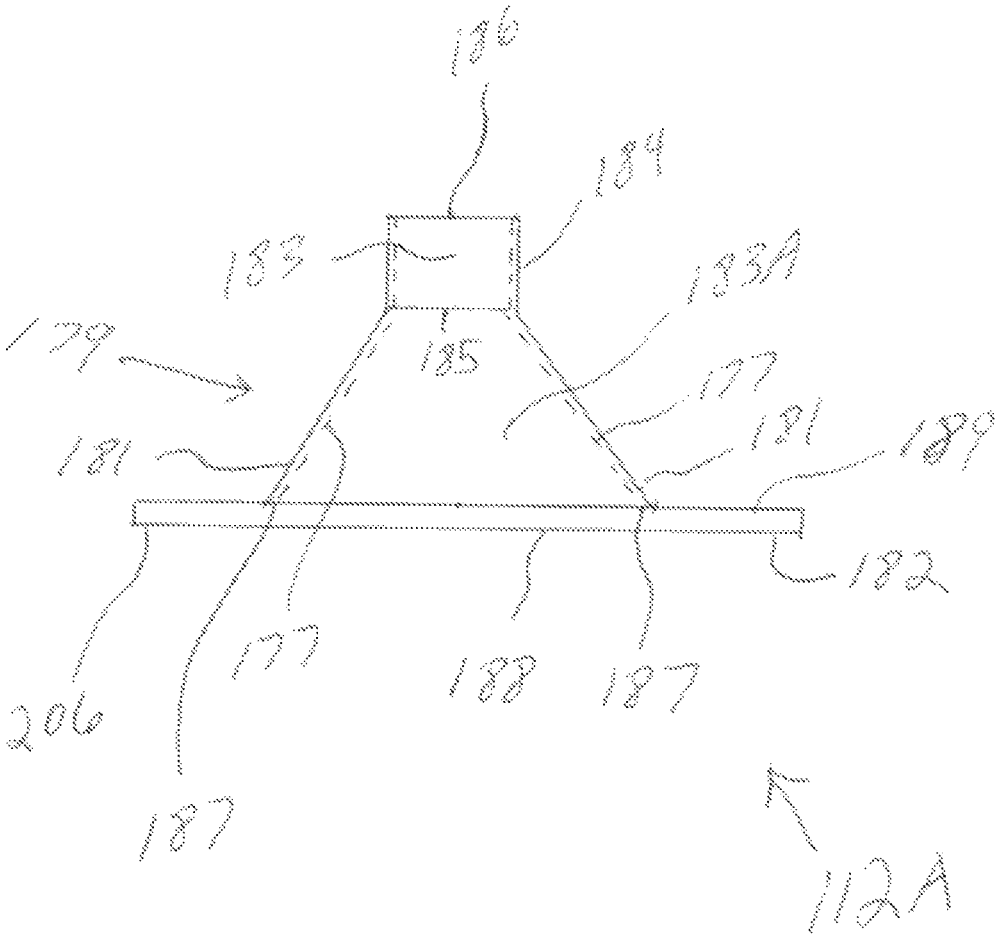
FIG. 27 is a top elevation view of an alternative shield member configuration of the alternative device of FIG. 12 in accordance with the present invention.
Figure 28:
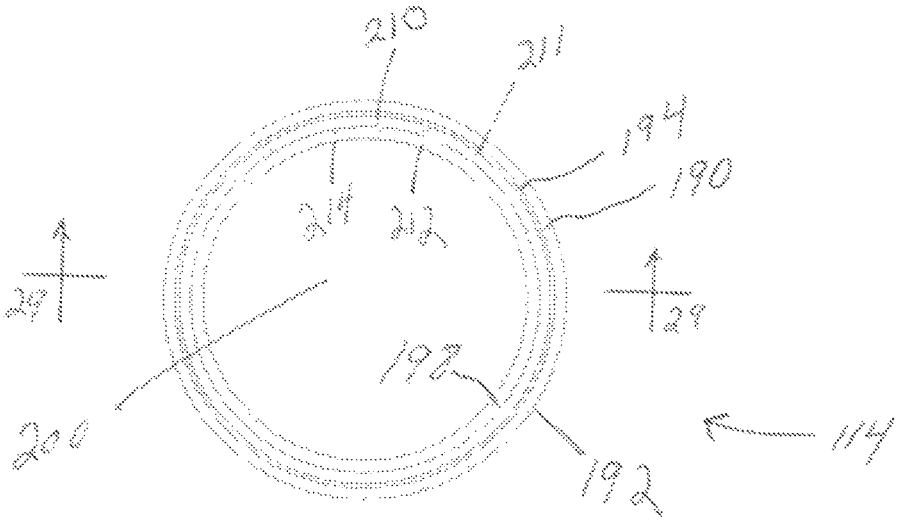
FIG. 28 is a back elevation view of a front end cover of the alternative device of FIG. 12 in accordance with the present invention.
Figure 29:
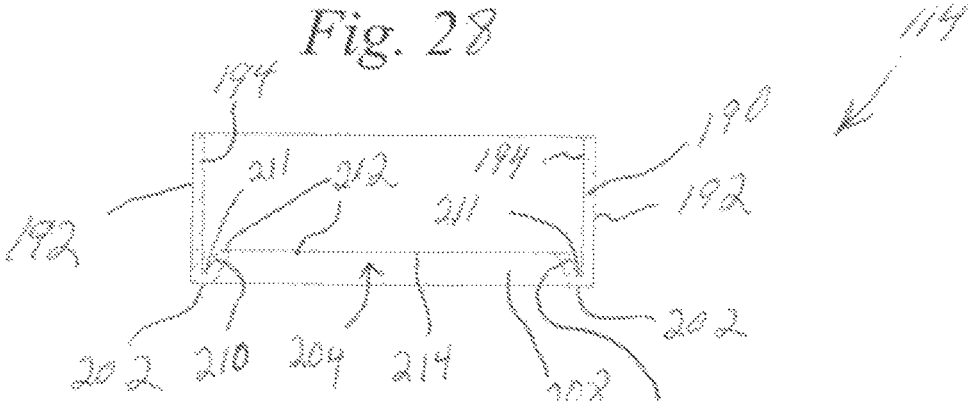
FIG. 29 is a section view taken along line 29-29 of the front end cover of FIG. 28.
Figure 30:
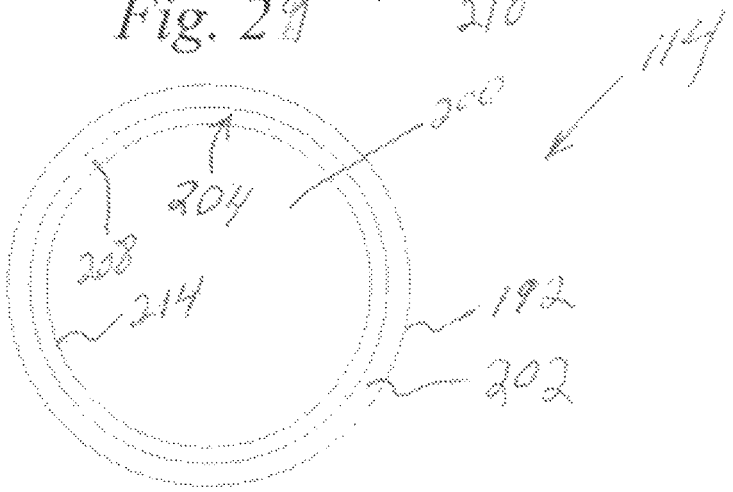
FIG. 30 is a front elevation view of the front end cover of FIG. 28.
Figure 31:
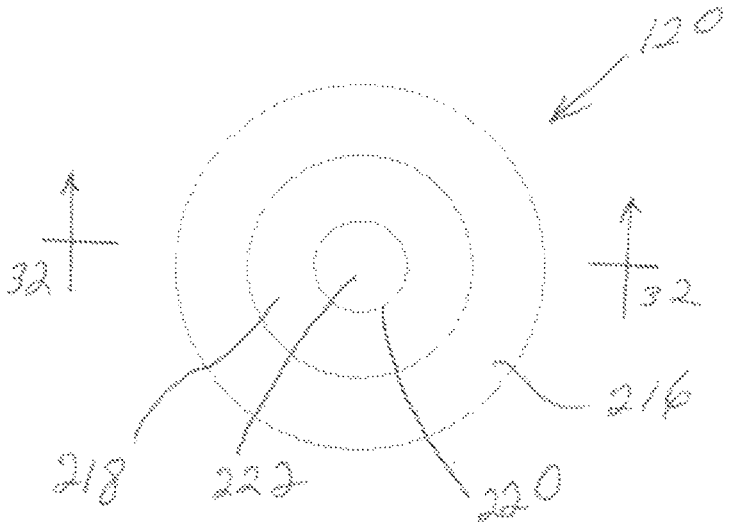
FIG. 31 is back elevation view of a back end cover of the alternative device of FIG. 12 in accordance with the present invention.
Figure 32:
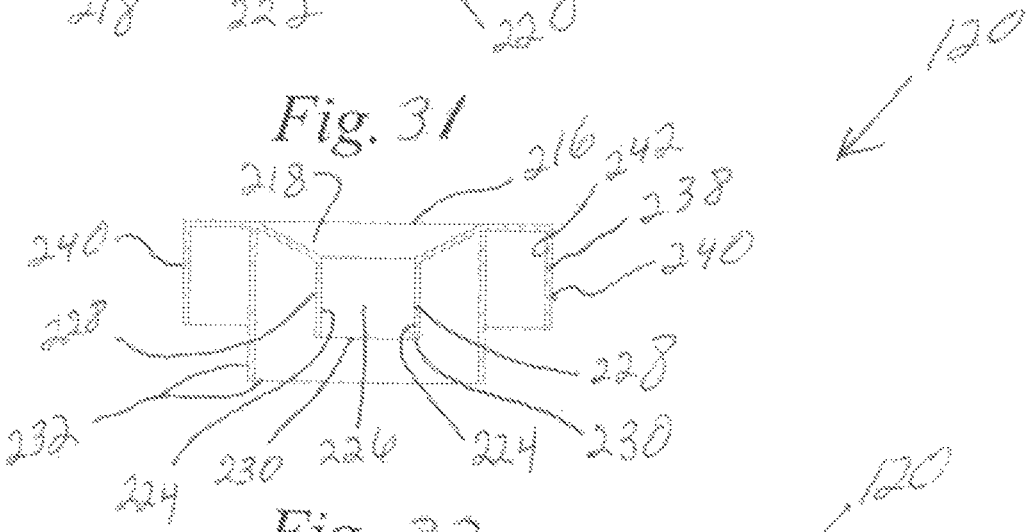
FIG. 32 is a section view taken along line 32-32 of the back end cover of FIG. 31.
Figure 33:
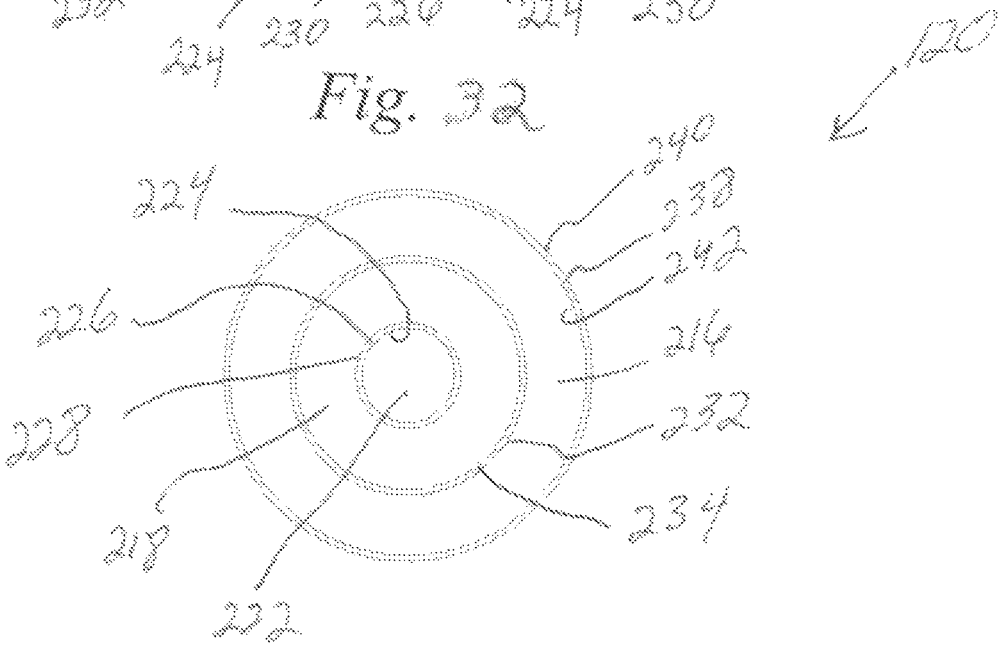
FIG. 33 is a front elevation view of the back end cover of FIG. 31.

Referring to FIG. 27, an alternative configuration for the shield member 112 is depicted. The alternative shield member 112A configuration includes an annular transparent lens portion 182 having opposing planar outer and inner annular walls 188 and 189. The alternative shield member 112A further includes a central annular aperture portion 183 coupled to a frustoconically configured aperture portion 183A. The annular aperture portion 183 is defined by an inner end portion 185 of a cylindrical tube portion 184 integrally joined to and axially aligned with a frustoconically configured portion 179 of the shield member 112A. An inner wall 177 of the frustoconical portion 179 defines the frustoconical aperture portion 183A. The inner wall 177 together with an outer wall 181 of the frustoconical portion 179 form an edge portion 187 that is integrally joined to an outer radial portion of the inner annular wall 189 of the lens portion 182, such that the central axis of the tube portion 184 and the central axis of the frustoconical portion 179 are axially aligned and intersect with the center of the lens portion 182. The outer wall 181 of the frustoconcial portion 179 includes a light reflective surface that ultimately directs emitted light from the lamps 110 through the outer radial portion 189 of the lens portion 182 between the outer wall 181 and the inner wall 170 of the light reflector 108, thereby reducing glare from the lamps 110 and improving illumination of the object being observed without infringing the view of the user.

Referring to FIGS. 12, 13, and 28-30, the front end cover 114 includes an outer cover portion 190 having an outer annular wall 192 and an inner annular wall 194 that are dimensioned and configured to promote rotational engagement between the inner wall 194 and cooperating threads (not depicted) of an annular front end portion 196 of the enclosure 102 to ultimately secure the front end cover 114 to the enclosure 102. The front end cover 114 further includes an inner aperture portion 198 that defines a central aperture 200 having an annular configuration with a diameter substantially equal to the inner diameter of the outer wall 162 of the light reflector 108 to allow maximum light emission from the light reflector 108 to illuminate a preselected object.

The inner aperture portion 198 is frustoconically configured and includes an annular outer base portion 202 and an annular inner engagement portion 204 which forcibly engages an edge portion 206 of the outer wall 188 of the shield member 112 to maintain the axial positions of the shield member 112 and the light reflector 108 relative to the spacer 106 after being inserted inside the enclosure 102. The inner aperture portion 198 further includes an outer conical wall 208 and a parallel inner conical wall 210 that are angled relatively to the outer base portion 202 to linearly align the inner engagement portion 204 with the conical wall 168 of the light reflector 108 such that an angular gap 211 is formed between the inner wall 194 of the cover portion 190 and the inner angular wall 210 of the inner aperture portion 198. The outer and inner conical walls 208 are separated a distance relatively larger than the "thickness" of the conical wall 168 of the light reflector 108. The walls 208 and 210 are sufficiently long to form a planar, annular engagement wall 212 that is parallel to the base portion 202 and parallel to the outer wall 188 of the shield member 112. The engagement wall 212 has a radial "thickness" substantially about the same as the radial thickness of the outer wall 162 of the light reflector 108. The engagement wall 212 includes an inner edge 214 having a diameter relatively smaller than the diameter of the base portion 202, the inner edge 214 defining the diameter of the aperture 200. The engagement wall 212 configuration provides substantial linear alignment between the inner conical wall 210 of the engagement portion 204 and the conical wall 168 of the light reflector 108 to provide sufficient surface engagement between the engagement wall 212 and the edge portion 206 of the outer wall of the lens 182, thereby distributing a manual force sufficient to secure the positions of the lens portion 182 of the shield member 112 and the light reflector 108 relative to the spacer 106 and enclosure 102 without damaging either the shield member 112 or the light reflector 108 as the front end cover 114 is rotationally secured upon the enclosure 102.

Referring to FIGS. 12, 13 and 31-33, the back end cover 120 includes an outer annular end wall 216 perpendicular to the longitudinal axis of the enclosure 102, and a frustoconically configured inner end wall 218 concentric with the outer end wall 216 to form a recess relative to the outer end wall 216 to promote the viewing by the user when looking through the viewing aperture 105 to locate the object illuminated by the flashlight device 100. The inner wall 218 includes an inner annular edge 220 that defines an inner annular wall 224 and aperture 222 of a first tube 226 perpendicular to the outer wall 216. The first tube 226 includes an inner diameter equal to the inner diameter of the inner wall 174 of the spacer 106. The first tube 226 includes an outer annular wall 228 that together with the inner wall 224, defines the radial thickness of the first tube 226 as being equal to the radial distance separating the inner and outer walls 174 and 140 of the tube 134, thereby promoting congruent engagement between an inner annular edge 230 of the first tube 226 and the end 224 of the sight tube 134 of the spacer 106 after the flashlight device 100 is assembled.

The back end cover 120 further includes a cylindrical engagement tube 232 having a diameter substantially equal to the inner diameter of the outer annular end wall 216, and axially aligned with and dimensioned to engage an end washer 137 of the battery retainer 116 such that an inner annular edge 234 of the engagement tube 232 maintains the position of or limits axial movement of the battery retainer 116 relative to the cylindrical tube 134 of the spacer 106. More specifically, the enclosure 102 includes a longitudinal dimension that results in a longitudinal gap 236 or separation between the edge 234 of the engagement tube 232 and the base member 138 of the spacer 106 that is relatively greater than the central axis dimension of the battery retainer 116. The greater longitudinal dimension of the gap 236 provides a power sizing option for the user when sizing a battery retainer 116 with corresponding batteries 118 for energizing the lights 110 over a preselected time period. Alternatively, the axial or longitudinal dimension of the gap 236 can be sized substantially equal to the axial dimension of the battery retainer 116, thereby limiting the power sizing option for the user. Further, a spring (not depicted) can be disposed circumferentially about the tube 134 of the spacer 106, and between the edge 234 of the engagement tube 232 and the respective washer 137 of the battery retainer 116 to forcibly urge the battery retainer 116 into communication with the base member 138 of spacer 106, thereby preventing the battery retainer 116 from axially moving inside enclosure 102.

The back end cover 120 also includes an outer cylindrical cover tube 238 having an outer annular wall 240 and an inner annular wall 242 that are dimensioned and configured to promote rotational engagement between the inner wall 242 and cooperating threads (not depicted) of an annular back end portion 244 of the enclosure 102 to ultimately secure the back end cover 120 to the enclosure 102 after the battery retainer 116 has been inserted inside the enclosure 102. To enhance a user's view of a distal object illuminated by the device 100, a magnifying eyepiece 18 can be cooperatively coupled to the end cover 120 via a myriad of techniques well known to those of ordinary skill, including but not limited to using a tube secured to the eyepiece 18 that snugly and removably inserts into an end portion of the first tube 226 such that the position of the eyepiece 18 relative to the enclosure 102 is maintained. The flashlight device 100 allows a user to direct light emitted from the device 100 down a conduit configuration 24 and simultaneously view and magnify, via the eyepiece 18, a predetermined object 22 proximate to an end portion 26 of the conduit 24 while manually supporting the device 100.

The foregoing description is for purpose of illustration only and is not intended to limit the scope of protection accorded this invention. The scope of protection is to be measured by the following claims, which should be interpreted as broadly as the inventive contribution permits.

The invention claimed is:

1. A flashlight device having an aperture for a user to view a predetermined object in a pipe, said object being illuminated by said device comprising:

an enclosure having front and back end covers;

a plurality of light bulbs disposed in a light reflector positioned in a front end of said enclosure;

a central viewing aperture extending longitudinally through and axially aligned with a central axis of said enclosure, said plurality of light bulbs being disposed annularly about and substantially an equal distance from a central axis of said central viewing aperture, said viewing aperture being aligned with the direction of the light emitted from said flashlight device, said central viewing aperture and said plurality of light bulbs cooperating to illuminate an object in a pipe irrespective of the location of the object in the pipe, and irrespective of the placement of said flashlight device adjacent to an end portion of the pipe so long as said central viewing aperture enables a user to view the object in the pipe;

means for maintaining the position of said light reflector in said enclosure; and means for energizing said plurality of lights, said energizing means including at least one battery, thereby enabling a user to shine a light emitted from said flashlight device into a pipe to illuminate an object and view the object through said viewing aperture, irrespective of the location of the object in the pipe, and irrespective of the placement of said flashlight device adjacent to an end portion of the pipe so long as said central viewing aperture enables the user to view the object in the pipe.

2. The device of claim 1 wherein said enclosure includes an eyepiece, said eyepiece providing means for amplifying the size of an object being observed by the user.

3. The device of claim 1 wherein said plurality of lights are disposed circumferentially about said viewing aperture.

4. The device of claim 1 wherein said light reflector is frustoconically configured and includes an inner annular wall having an outer diameter less than the outer diameter of an outer annular wall, and axially aligned with and distally displaced from said outer wall such than an inner engagement member contacts outer edge portions of positioning walls, thereby preventing further insertion of said light reflector into said enclosure.

5. The device of claim 4 wherein said inner and outer annular walls of said light reflector define a conically configured wall having an inner reflective surface that directs light through a shield member to illuminate a preselected object.

6. The device of claim 1 wherein said energizing means includes a battery retainer having a plurality of battery slots configured and dimensioned to snugly receive and retain cooperatively configured and dimensioned batteries that engage and electrically connect corresponding positive terminals and negative end portions of the batteries to electrical wires to ultimately energize said lights in said light reflector.

7. The device of claim 6 wherein said energizing means includes four standard 1.5 volt batteries series connected to a switch via wires to provide six volts via wires to each of said lights, connected in parallel.

8. The device of claim 1 wherein said means for maintain the position of said light reflector in said enclosure includes a spacer member having a cylindrical sight tube with an aperture therethrough and a cylindrically configured base member with opposing planar walls that is integrally and radially joined to an outer wall of said sight tube at any distance from a front end of said sight tube to half the longitudinal length of said device.

9. The device of claim 1 wherein said enclosure includes a shield member having an annular transparent lens portion with opposing planar outer and inner annular walls, and a central aperture defined by an inner end portion of a cylindrical tube portion integrally and perpendicularly joined to said lens portion such that the central axis of said cylindrical tube portion intersects the center of said annular transparent lens portion.

10. The device of claim 1 wherein said enclosure includes a shield member having a configuration with an annular transparent lens portion having opposing planar outer and inner annular walls, and a central annular aperture portion coupled to a frustoconically configured aperture portion, said annular aperture portion is defined by an inner end portion of a cylindrical tube portion integrally and axially joined to a frustoconically configured portion of said shield member, said frustoconical portion having an inner wall defining said frustoconical aperture portion, said inner wall of said frustoconical portion together with an outer wall of said frustoconical portion forming an edge portion that is integrally joined to an outer radial portion of said inner annular wall of said lens portion, such that the central axis of said tube portion and the central axis of said frustoconical portion are axially aligned and intersect with the center of said lens portion, said outer wall of said frustoconical portion including a light reflective surface that ultimately directs emitted light from said lamps through said outer radial portion of said lens portion between said outer and inner walls of said light reflector, thereby reducing glare from said lamps and improving illumination of the object being observed without infringing the view of the user.

11. The device of claim 1 wherein said front end cover of said enclosure includes an outer cover portion with an outer annular wall and an inner annular wall that are dimensioned and configured to promote rotational engagement between said inner wall and cooperating threads of an annular front end portion of said enclosure to ultimately secure said front end cover to said enclosure, said front end cover including an inner aperture portion that defines a central aperture having an annular configuration with a diameter substantially equal to the inner diameter of an outer wall of said light reflector to allow maximum light emission from said light reflector to illuminate a preselected object; and said back end cover of said enclosure includes a cylindrical engagement tube having a diameter substantially equal to the inner diameter of an outer annular end wall, said cylindrical engagement tube being axially aligned with and dimensioned to engage an end washer of a battery retainer such that an inner annular edge of said engagement tube maintains the axial position of said battery retainer relative to said cylindrical tube of said spacer, thereby providing a longitudinal viewing aperture through said flashlight device to enable a user to illuminate an object in a confined space and simultaneously view the object through said viewing aperture, irrespective of the location of the illuminated object in the confined space.

12. A flashlight device having an aperture for a user to view a predetermined object illuminated by said device comprising:

an enclosure having front and back end covers;

a plurality of light bulbs disposed in a light reflector positioned in a front end of said enclosure;

a viewing aperture extending longitudinally through said enclosure, said viewing aperture being aligned with the direction of the light emitted from said flashlight device;

means for maintaining the position of said light reflector in said enclosure, said means for maintain the position of said light reflector in said enclosure including a spacer member having a cylindrical sight tube with an aperture therethrough and a cylindrically configured base member with opposing planar walls that is integrally and radially joined to an outer wall of said sight tube at any distance from a front end of said sight tube to half the longitudinal length of said device, said spacer member including first and second side positioning walls, and a bottom positioning wall, said positioning walls being integrally secured to an outer wall of said cylindrical sight tube via lineal longitudinal edge portions of each of said positioning walls, said edge portions being secured longitudinally parallel to a central longitudinal axis of said sight tube such that a lateral axis of each lineal longitudinal edge portion perpendicularly intersects said central longitudinal axis of said sight tube; and means for energizing said plurality of lights, said energizing means including at least one battery, thereby enabling a user to shine a light emitted from said flashlight device into a confined space to illuminate an object and view the object through said viewing aperture, irrespective of the location of the object in the confined space.

13. The device of claim 12 wherein said positioning walls maintain the lateral position of said spacer member relative to said enclosure after said spacer member is inserted into said enclosure a predetermined lineal distance, said first side and bottom positioning walls being radially separated substantially about one hundred and five degrees, said second side and bottom positioning walls being radially separated one hundred and five degrees plus or minus thirty degrees, resulting in an angle between said first and second side positioning walls of one hundred and fifty degrees plus or minus thirty degrees.

14. The device of claim 13 wherein said one hundred and fifty degrees of radial separation between said first and second side positioning walls promotes an upper recess between said spacer member and an inner wall of said enclosure that promotes the insertion of a switch into said enclosure, and promotes the routing of wires to said switch and said lights, such that said switch energizes and de-energizes all of said lights.

15. The device of claim 14 wherein said cylindrically configured base member is integrally secured to lineal lateral inner edges of said positioning walls, said cylindrically configured base member being dimensioned and cylindrically configured to insert into said enclosure until angle edge portions of each of said three side positioning walls engage a cooperating angle wall portion of said inner wall of said enclosure to restrict further axial movement of said spacer into said enclosure.

16. The device of claim 15 wherein said cylindrically configured base member is snugly inserted into a section of said flashlight device having a diameter relatively smaller than the diameter of a light section of said flashlight device, said angle edge portions of said positioning walls, when engaging said cooperating wall portion of said inner wall of said enclosure, cooperate with inner and outer longitudinal edges of said position walls, which engage corresponding longitudinal portions of said inner wall of a battery section and light section, respectively, to laterally maintain axial alignment of the central longitudinal axis of said cylindrical sight tube with the central longitudinal axis of said enclosure, irrespective of the orientation of the flashlight device.

17. A flashlight device having an aperture for a user to view a predetermined object illuminated by said device comprising:

an enclosure having front and back end covers;

a plurality of light bulbs disposed in a light reflector positioned in a front end of said enclosure;

a viewing aperture extending longitudinally through said enclosure, said viewing aperture being aligned with the direction of the light emitted from said flashlight device;

means for maintaining the position of said light reflector in said enclosure; and means for energizing said plurality of lights, said energizing means including a battery retainer having a plurality of battery slots configured and dimensioned to snugly receive and retain cooperatively configured and dimensioned batteries that engage and electrically connect corresponding positive terminals and negative end portions of the batteries to electrical wires to ultimately energize said lights in said light reflector, said battery retainer including battery slots formed via longitudinal edges of planar walls longitudinally secured to an outer wall of a cylindrical tube, said planar walls including lateral edges secured to inner cylindrical walls of opposing end washers, such that said longitudinal edges of said planar walls are parallel to the longitudinal axis of a central aperture defined by an inner cylindrical wall of said cylindrical tube, said central aperture extending through said battery retainer, thereby enabling a user to shine a light emitted from said flashlight device into a confined space to illuminate an object and view the object through said viewing aperture, irrespective of the location of the object in the confined space.

18. A flashlight device having an aperture for a user to view a predetermined object illuminated by said device comprising:

an enclosure having front and back end covers, said enclosure including a shield member having an annular transparent lens portion with opposing planar outer and inner annular walls, and a central aperture defined by an inner end portion of a cylindrical tube portion integrally and perpendicularly joined to said lens portion such that the central axis of said cylindrical tube portion intersects the center of said annular transparent lens portion, said cylindrical tube portion having an axial longitudinal dimensions that results in an end portion of said cylindrical tube portion engaging a surface portion of an inner extension member, said lens portion having an outer diameter greater than the inner diameter of said outer wall of said light reflector, and smaller than the outer diameter of said outer wall, said outer diameter of said lens portion and the longitudinal dimension of said cylindrical tube portion, resulting in said lens portion engaging said outer wall of said light reflector, and said end portion engaging said inner extension member; thereby maintain axial alignment between said cylindrical tube portion of said shield member, said light reflector, and said cylindrical tube portion of said spacer to maximize the user's view of the object being illuminated by said flashlight device;

a plurality of light bulbs disposed in a light reflector positioned in a front end of said enclosure; a viewing aperture extending longitudinally through said enclosure, said viewing aperture being aligned with the direction of the light emitted from said flashlight device;

means for maintaining the position of said light reflector in said enclosure; and means for energizing said plurality of lights, said energizing means including at least one battery, thereby enabling a user to shine a light emitted from said flashlight device into a confined space to illuminate an object and view the object through said viewing aperture, irrespective of the location of the object in the confined space.

19. A flashlight device for viewing an object illuminated in a conduit by said flashlight device comprising:

an enclosure having a viewing aperture extending centrally and longitudinally through said enclosure such that said viewing aperture is axially aligned with a central axis of said enclosure;

a plurality of lamps disposed in a substantially annular configuration about said viewing aperture, said plurality of lamps each being disposed a substantially equal distance from a central axis of said viewing aperture, said viewing aperture and said plurality of lamps cooperating to illuminate an object in a conduit irrespective of the location of the object in the conduit, and irrespective of the placement of said flashlight device adjacent to an end portion of the conduit so long as the central viewing aperture enables a user to view the object in the conduit; and means for energizing said lamps, said energizing means including at least one battery, thereby enabling a user to direct light emitted from said lamps into a conduit to illuminate the object in the conduit, thereby enabling the user to view the object via said viewing aperture such that said enclosure does not obstruct the user's line of sight of the illuminated object irrespective of the location of the object in the conduit, and irrespective of the placement of said flashlight device adjacent to an end portion of the conduit so long as said central viewing aperture enables the user to view the object in the conduit.

20. A flashlight device for viewing an object in a confined space comprising:

an enclosure having a viewing aperture extending centrally and longitudinally through said enclosure such that said viewing aperture is axially aligned with a central axis of said enclosure;

a plurality of lamps disposed in a substantially annular configuration about said viewing aperture, said plurality of lamps each being disposed a substantially equal distance from a central axis of said viewing aperture, said viewing aperture and said plurality of lamps cooperating to illuminate an object in a confined space irrespective of the location of the object in the confined space, and irrespective of the placement of said flashlight device adjacent to the confined space so long as said central viewing aperture enables a user to view the object in the confined space; and means for energizing said lamp, said energizing means including at least one battery, thereby enabling a user to direct light emitted from said lamp into a confined space to illuminate an object in the confined space, and the user being enabled to view the illuminated object via said viewing aperture without his or her view being obstructed by said enclosure irrespective of the location of the object in the confined space, and irrespective of the placement of said flashlight device adjacent to the confined space so long as said central viewing aperture enables the user to view the object in the confined space.

* * * * *